US012624493B2

(12) United States Patent
Cho et al.

(10) Patent No.: US 12,624,493 B2
(45) Date of Patent: May 12, 2026

(54) LAUNDRY TREATING APPARATUS

(71) Applicant: LG Electronics Inc., Seoul (KR)

(72) Inventors: Sangho Cho, Seoul (KR); Youngho Jung, Seoul (KR); Daehan Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 43 days.

(21) Appl. No.: 18/765,764

(22) Filed: Jul. 8, 2024

(65) Prior Publication Data

US 2024/0360613 A1 Oct. 31, 2024

Related U.S. Application Data

(63) Continuation of application No. 17/179,909, filed on Feb. 19, 2021, now Pat. No. 12,054,875.

(30) Foreign Application Priority Data

Feb. 19, 2020 (KR) ..... 10-2020-0020457
Oct. 14, 2020 (KR) ..... 10-2020-0132545

(51) Int. Cl.
*D06F 39/12* (2006.01)
*D06F 29/00* (2006.01)
(Continued)

(52) U.S. Cl.
CPC ..... *D06F 39/125* (2013.01); *D06F 29/005* (2013.01); *D06F 31/00* (2013.01); *D06F 34/34* (2020.02); *D06F 58/20* (2013.01)

(58) Field of Classification Search
CPC ..... D06F 39/125
See application file for complete search history.

(56) References Cited

U.S. PATENT DOCUMENTS 9,388,523 B2 7/2016 Han et al.
2010/0101282 A1 4/2010 Jeong et al.

FOREIGN PATENT DOCUMENTS

CN 108796980 A 11/2018
EP 2703536 A1 3/2014
(Continued)

OTHER PUBLICATIONS

Office Action in Korean Appln. No. 10-2023-0161500, mailed on Dec. 17, 2024, 13 pages (with English translation).
(Continued)

*Primary Examiner* — Jason Y Ko
(74) *Attorney, Agent, or Firm* — Fish & Richardson P.C.

(57) ABSTRACT

A laundry treating apparatus includes: a first treating apparatus including a first front panel disposed at a front side of the first treating apparatus, a plurality of first side panels disposed at both lateral sides of the first treating apparatus, and a first drum configured to receive laundry, and a second treating apparatus that is disposed below the first treating apparatus to support the first treating apparatus and that includes a second front panel disposed at a front side of the second treating apparatus, a plurality of second side panels disposed at both lateral sides of the second treating apparatus, and a second drum configured to receive the laundry. The second treating apparatus includes an upper frame that is disposed at a rear side of the second front panel and that is coupled to the first treating apparatus through an insulating connection member made of an electrically insulating material.

24 Claims, 24 Drawing Sheets

(51) Int. Cl.

| | |
|---|---|
| ***D06F 31/00*** | (2006.01) |
| ***D06F 34/34*** | (2020.01) |
| ***D06F 58/20*** | (2006.01) |

(56) References Cited

FOREIGN PATENT DOCUMENTS

| | | | |
|---|---|---|---|
| KR | 10-2006-0089787 | A | 8/2006 |
| KR | 10-2008-0065765 | A | 7/2008 |
| KR | 10-2010-0020628 | A | 2/2010 |
| KR | 10-2011-0020366 | A | 3/2011 |
| KR | 10-1921181 | B1 | 2/2019 |
| RU | 2401341 | C1 | 10/2010 |
| RU | 2404308 | C1 | 11/2010 |

OTHER PUBLICATIONS

Notice of Allowance in Australian Appln. No. 2023203777, mailed on Aug. 15, 2025, 4 pages.
Office Action in Russian Appln. No. 2022102972, mailed on Oct. 3, 2025, 6 pages.
Notice of Allowance in Japanese Appln. No. 2023-061769, mailed on Nov. 4, 2025, 6 pages (with English translation).
Notice of Allowance in European Appln. No. 24159937.2, mailed on Jan. 23, 2026, 7 pages.

LAUNDRY TREATING APPARATUS

CROSS-REFERENCE TO RELATED APPLICATIONS

This application is a continuation of U.S. application Ser. No. 17/179,909, filed on Feb. 19, 2021, which claims the benefit of the earlier filing date and the right of priority to Korean Patent Application No. 10-2020-0020457, filed on Feb. 19, 2020, and Korean Patent Application No. 10-2020-0132545, filed on Oct. 14, 2020, which are hereby incorporated by reference in their entirety.

TECHNICAL FIELD

The present disclosure relates to a laundry treating apparatus, and relates to a laundry treating apparatus including a first treating apparatus on an upper side and a second treating apparatus on a lower side.

BACKGROUND

A laundry treating apparatus is an apparatus that puts laundry such as clothes, bedding, and the like into a drum to perform treatment necessary for the laundry, such as to remove contamination from the laundry or to dry the laundry.

When the laundry treating apparatus is designed to remove the contamination from the laundry, the laundry treating apparatus may perform processes such as washing, rinsing, dehydration, drying, and the like. The laundry treating apparatuses can be classified into a top loading type laundry treating apparatus and a front loading type laundry treating apparatus based on a scheme of putting the laundry into the drum.

The laundry treating apparatus can include a cabinet defining an appearance of the laundry treating apparatus, a tub accommodated in the cabinet, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry can be removed by friction with the drum and the wash water.

The detergent feeder can perform a detergent feeding function to improve a washing effect. Herein, the detergent may refer to a substance, such as fabric detergent, fabric softener, fabric bleach, and the like, that enhances the washing effect. Detergent in a powder form and detergent in a liquid form may be used as the detergent.

For example, when the laundry treating apparatus is designed to dry the laundry, the laundry treating apparatus can remove moisture from the laundry by supplying dry air to the laundry.

The laundry treating apparatus can include a cabinet, a drum rotatably disposed inside the cabinet, heating means for heating or drying the air supplied to the laundry, and the like.

As the dry air is supplied to the laundry accommodated in the drum, the moisture present in the laundry can be evaporated and removed by the dry air, and water can be removed from the laundry.

For example, a conventional laundry treating apparatus can be equipped with a plurality of treating apparatuses. The conventional laundry treating apparatus can include a first treating apparatus on an upper side and a second treating apparatus on a lower side. In addition, the conventional laundry treating apparatus can have a structure in which each of the first treating apparatus and the second treating apparatus has a manipulation unit and a display.

However, the conventional laundry treating apparatus has the structure in which the plurality of treating apparatuses distinguished from each other have respective manipulation units and respective displays. In this case, a user must respectively identify states of the respective plurality of treating apparatuses, and must respectively manipulate the plurality of treating apparatuses. In addition, it may be disadvantageous for the user to operate the plurality of treating apparatuses in conjunction with each other.

In addition, the plurality of treating apparatuses may respectively include different electricity consuming devices. A short circuit can occur from the electric consuming device, an electric wire, or the like by other substances such as water, moisture, refrigerant, and the like inside the treating apparatus.

The occurrence of the short circuit in the situation where the plurality of treating apparatuses are arranged may affect not only a corresponding treating apparatus but also the electricity consuming device disposed inside the treating apparatus.

Therefore, in the laundry treating apparatus equipped with the plurality of treating apparatuses, it is an important task to improve convenience of a user in identifying or manipulating operating states of the plurality of treating apparatuses, and limit an occurrence of malfunction or damage resulted from unintentional electrical connection between the plurality of treating apparatuses.

SUMMARY

The present disclosure is directed to a laundry treating apparatus in which a plurality of treating apparatuses are effectively electrically insulated from each other and provide a stable coupling relationship with each other.

In addition, the present disclosure is directed to a laundry treating apparatus with efficient arrangement and coupling structures of a control panel for simultaneously identifying or controlling a plurality of treating apparatuses for treating laundry.

According to one aspect of the subject matter described in this application, a laundry treating apparatus includes a first treating apparatus including a first front panel disposed at a front side of the first treating apparatus, a plurality of first side panels disposed at both lateral sides of the first treating apparatus, and a first drum configured to receive laundry, and a second treating apparatus that is disposed below the first treating apparatus to support the first treating apparatus and that includes a second front panel disposed at a front side of the second treating apparatus, a plurality of second side panels disposed at both lateral sides of the second treating apparatus, and a second drum configured to receive the laundry, where the second treating apparatus includes an upper frame that is disposed at a rear side of the second front panel and that is coupled to the first treating apparatus through an insulating connection member made of an electrically insulating material.

Implementations according to this aspect can include one or more of the following features. For example, a lower portion of the upper frame can be coupled to the plurality of second side panels, and an upper portion of the upper frame can be coupled to the plurality of first side panels through the insulating connection member.

In some implementations, the insulating connection member can include a first fastening portion coupled to one of the plurality of first side panels, and a second fastening portion coupled to the upper frame. The second fastening portion is configured to electrically insulate the upper frame and the one of the plurality of first side panels from each other. In some examples, the first fastening portion can extend upward from the second fastening portion, and the upper frame and the second fastening portion can be fastened to the one of the plurality of first side panels through the first fastening portion.

In some examples, the laundry treating apparatus further includes a first fastening member configured to penetrate the first fastening portion and the one of the plurality of first side panels to fasten the first fastening portion to the one of the plurality of first side panels, and a second fastening member that is configured to penetrate the upper frame and that is inserted into the second fastening portion to fasten the upper frame to the second fastening portion. The second fastening portion can be configured to electrically insulate the second fastening member and the one of the plurality of first side panels from each other. In some examples, the second fastening portion can include a fastening insulating portion extending to penetrate the one of the plurality of first side panels, at least a portion of the second fastening member can be inserted into the fastening insulating portion, and the fastening insulating portion can be configured to electrically insulate the second fastening member and the one of the plurality of first side panels from each other.

In some implementations, each of the plurality of first side panels can include a front bending portion that is disposed at a front end of the first side panel and that is disposed in parallel to the first front panel, and the fastening insulating portion can be configured to penetrate the front bending portion. In some implementations, the second front panel can define an upper fastening portion at an upper end, the upper fastening portion and the upper frame can be penetrated by the second fastening member to be fastened to the second fastening portion.

In some implementations, the laundry treating apparatus can further include a control panel that is disposed between the first front panel and the second front panel and that is made of an electrically insulating material. In some examples, the first treating apparatus can further include a lower frame coupled to a rear side of the control panel to fix the control panel to the first treating apparatus. The lower frame can be spaced apart from the upper frame and coupled to the plurality of first side panels.

In some implementations, the laundry treating apparatus can further include a rear bracket that is made of an electrically insulating material, that is disposed at a rear side of each of the first treating apparatus and the second treating apparatus, and that is configured to fasten the first treating apparatus and the second treating apparatus to each other. In some examples, the first treating apparatus can include a first rear panel disposed at a rear side of the first treating apparatus, the second treating apparatus can include a second rear panel disposed at a rear side of the second treating apparatus, and an upper portion of the rear bracket can be coupled to the first rear panel and a lower portion of the rear bracket can be coupled to the second rear panel such that the rear bracket can be configured to fasten the first rear panel and the second rear panel to each other.

In some examples, the first treating apparatus can include a first rear panel disposed at a rear side of the first treating apparatus, the second treating apparatus can include a second rear panel disposed at a rear side of the second treating apparatus, the first rear panel can be shorter than the second rear panel with respect to the first treating apparatus and the second treating apparatus, and a front surface of the rear bracket can be stepped such that an upper portion of the rear bracket supporting the first rear panel is positioned to be closer to the first treating apparatus and the second treating apparatus than a lower portion of the rear bracket supporting the second rear panel.

In some examples, the lower portion of the rear bracket can include a handle that opens downward. In some implementations, the first treating apparatus can further include a first bottom panel that is disposed on a bottom side of the first treating apparatus, that is supported by the second treating apparatus, and that is made of an electrically insulating material to be electrically insulated from the second treating apparatus.

In some implementations, the laundry treating apparatus can further include an insulating support that supports a lower portion of the first treating apparatus from an upper portion of the second treating apparatus and that is made of an electrically insulating material to electrically insulate the first treating apparatus and the first treating apparatus from each other.

According to another aspect of the subject matter described in this application, a laundry treating apparatus includes a first treating apparatus including a first front panel disposed at a front side of the first treating apparatus, a plurality of first side panels disposed at both lateral sides of the first treating apparatus, and a first drum configured to receive laundry, and a second treating apparatus that is disposed below the first treating apparatus to support the first treating apparatus and that includes a second front panel disposed at a front side of the second treating apparatus, a plurality of second side panels disposed at both lateral sides of the second treating apparatus, and a second drum configured to receive the laundry where an upper fastening portion defined at an upper end of the second front panel is coupled to the first side panel through an insulating connection member made of an electrically insulating material.

Implementations according to this aspect can include one or more following features. For example, the second treating apparatus can include an upper frame that is disposed at a rear side of the second front panel and that is coupled to the first treating apparatus through the insulating connection member.

In some examples, the insulating connection member can include a first fastening portion coupled to one of the plurality of first side panels, and a second fastening portion coupled to the upper frame. The second fastening portion can be configured to insulate the upper frame and the one of the plurality of first side panels from each other. In some examples, the first fastening portion can extend upward from the second fastening portion, and the upper frame and the second fastening portion can be fastened to the one of the plurality of first side panels through the first fastening portion.

DETAILED DESCRIPTION

Figure 1:
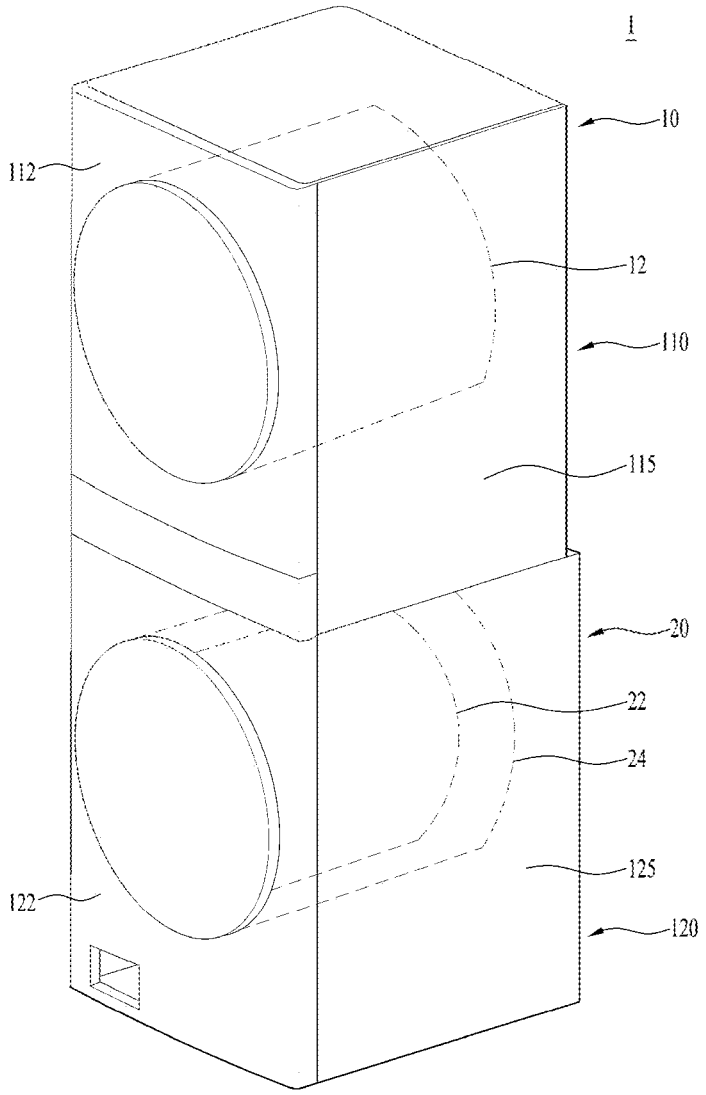
FIG. 1 is a diagram illustrating a perspective view of an exemplary laundry treating apparatus.

FIG. 1 is a diagram illustrating a laundry treating apparatus 1. The laundry treating apparatus 1 can include a first treating apparatus 10 and a second treating apparatus 20. The first treating apparatus 10 and the second treating apparatus 20 can be in various types for treating laundry where the types include a washing machine for washing the laundry or a dryer for drying the laundry.

For example, the first treating apparatus 10 positioned on an upper side in FIG. 1, which is a dryer for drying the laundry, can have a first drum 12 disposed therein. The second treating apparatus 20 that is located on a lower side and supports the first treating apparatus 10 can correspond to the washing machine for washing the laundry, and can have a second drum 22 and a tub 24 arranged therein. When the second treating apparatus 20 corresponds to the laundry washing machine, the second drum 22 inside the second treating apparatus 20 can be rotatably disposed inside the tub 24.

In some implementations, the first treating apparatus 10 and the second treating apparatus 20 may not be limited to the above types. For example, both the first treating apparatus 10 and the second treating apparatus 20 can be the washing machines or the dryers. In addition or alternatively, the first treating apparatus 10 can be the washing machine, and the second treating apparatus 20 can be the dryer. The first treating apparatus 10 and the second treating apparatus 20 can be various apparatuses for treating the laundry.

The first treating apparatus 10 can include a first cabinet 110 defining an appearance of the first treating apparatus 10, and the first cabinet 110 can have a first front panel 112 on a front face of the first cabinet 110. A laundry inlet in communication with the first drum 12 can be defined in the first front panel 112, and the laundry inlet can be opened and closed by a cabinet door.

Figure 23:
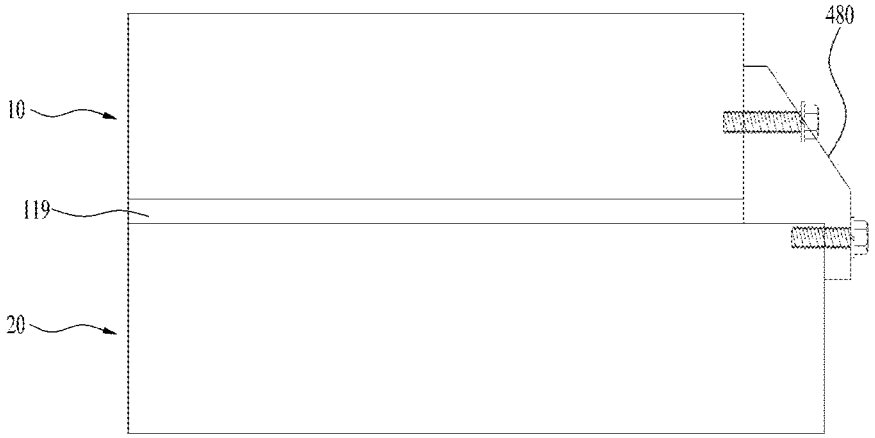
FIG. 23 is a diagram illustrating a view of a first bottom panel of a first treating apparatus in the exemplary laundry treating apparatus.

In some implementations, the first treating apparatus 10 can have first side panels 115 on each of both faces thereof in a left and right direction, a first rear panel 118 on a rear face thereof (see FIG. 20), a first top panel on a top face thereof, and a first bottom panel 119 on a bottom face thereof (see FIG. 23).

The first front panel 112, the first side panels 115, the first rear panel 118, the first top panel, and the first bottom panel 119 can provide the first cabinet 110 together, and have a coupling relationship with each other, and define a space in which internals constituting the first treating apparatus 10 such as the first drum 12 are arranged.

In the first treating apparatus 10, the laundry requiring the treatment and the like may be inserted into the first cabinet 110 through the laundry inlet and accommodated in the first drum 12, and a treating process by the first treating apparatus 10 such as washing, drying, and the like can be performed.

In some implementations, the first treating apparatus 10 can include (i) the laundry inlet defined in the first front panel 112 along with the cabinet door and (ii) the first drum 12 having a rotation axis parallel to a front and rear direction.

In some implementations, the laundry inlet can be defined in the first side panel 115, the first top panel, or the like with the cabinet door. For example, the first treating apparatus 10 can be a front loader type or a top loader type.

The second treating apparatus 20 can include a second cabinet 120 defining an appearance the second treating apparatus 20, and the second cabinet 120 can have a second front panel 122 on a front face thereof. A laundry inlet in communication with the second drum 22 can be defined in the second front panel 122, and the laundry inlet can be opened and closed by a cabinet door.

In some implementations, the second treating apparatus 20 can have second side panels 125 on each of both faces thereof in the left and right direction, a second rear panel 128 on a rear face thereof (see FIG. 20), a second top panel on a top face thereof, and a second bottom panel on a bottom face thereof.

The second front panel 122, the second side panels 125, the second rear panel 128, the second top panel, and the second bottom panel can provide the second cabinet 120 together, and have a coupling relationship with each other, and define a space in which internals constituting the second treating apparatus 20 such as the second drum 22 and the tub 24 are arranged.

In the second treating apparatus 20, the laundry requiring the treatment and the like may be inserted into the second cabinet 120 through the laundry inlet and accommodated in the second drum 22, and a treating process by the second treating apparatus 20 such as the washing, the drying, and the like can be performed.

In some implementations, the second treating apparatus 20 can include (i) the laundry inlet defined in the second front panel 122 along with the cabinet door and (ii) the second drum 22 having a rotation axis parallel to the front and rear direction.

In some implementations, the laundry inlet can be defined in the second side panel 125, the second top panel, or the like with the cabinet door. For example, the first treating apparatus 10 can be the front loader type or the top loader type.

For example, the laundry inserted through the first front panel 112 can be accommodated in the first drum 12 to perform the washing, the drying or other treating processes, and the laundry inserted through the second front panel 122 can be accommodated in the second drum 22 to perform the washing, the drying, or other treating processes.

The first treating apparatus 10 can be disposed on the second treating apparatus 20, and thus, the second treating apparatus 20 can have a structure supporting the first treating apparatus 10 upward. For example, the second top panel of the second treating apparatus 20 can have a structure of directly or indirectly supporting the first bottom panel 119 of the first treating apparatus 10, and a bottom of the first treating apparatus 10 can be coupled to a top of the second treating apparatus 20.

Figure 2:
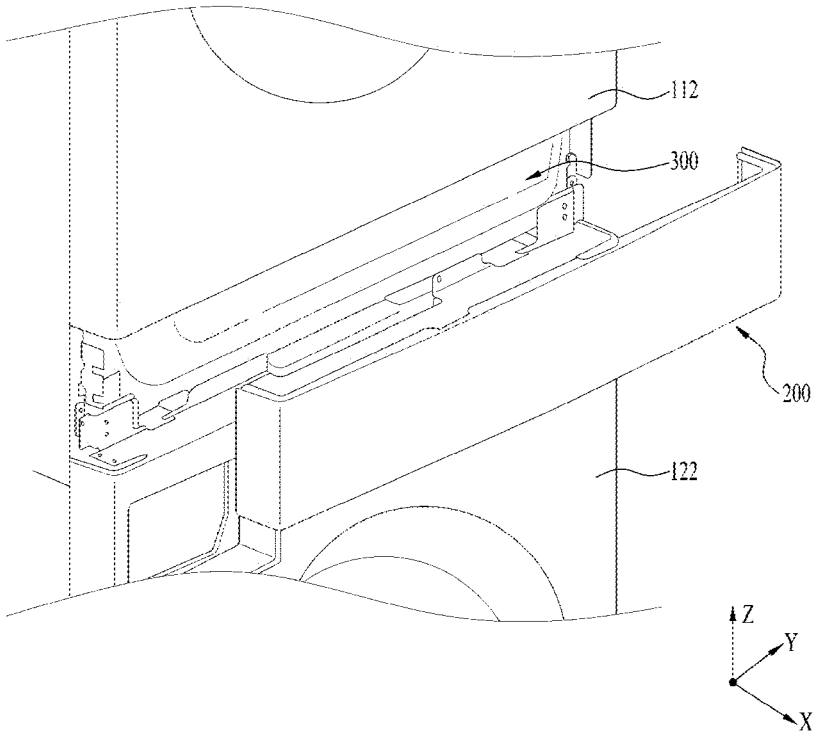
FIG. 2 is a diagram illustrating a control panel separated from the exemplary laundry treating apparatus.

Referring to FIG. 2, a control panel 200 can be disposed between the first front panel 112 and the second front panel 122. The control panel 200 can be signally connected to at least one of the first treating apparatus 10 or the second treating apparatus 20.

Figure 9:
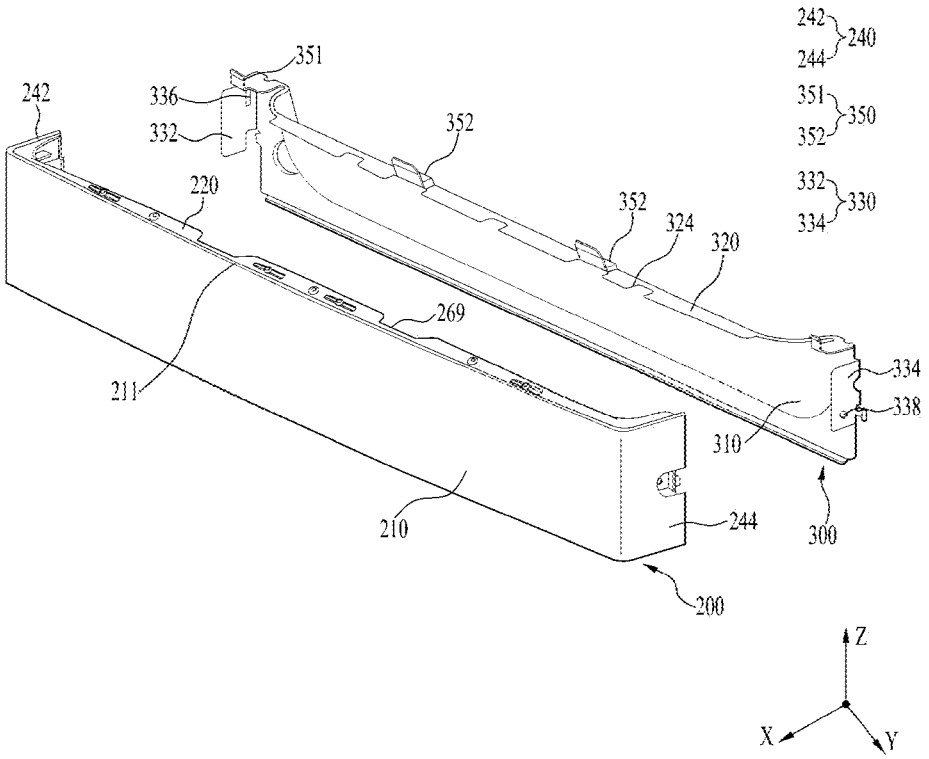
FIG. 9 is a diagram illustrating a view of a control panel and a lower frame in the exemplary laundry treating apparatus.

The control panel 200 can have a front face 210, and side faces 240 on both sides in the left and right direction Y (see FIG. 9). The side face 240 can include a first side face 242 on one side in the left and right direction Y and a second side face 244 on the other side (see FIG. 9).

Figure 12:
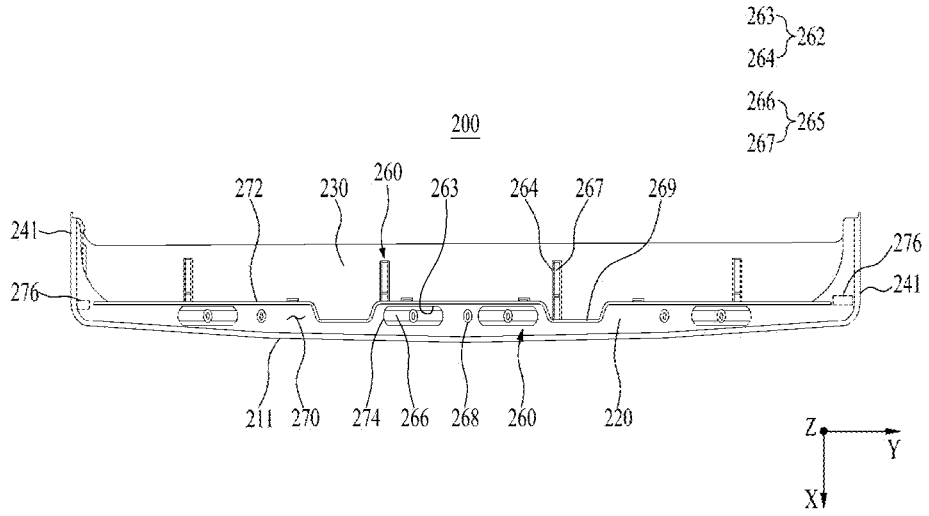
FIG. 12 is a diagram illustrating a top view of a control panel of the exemplary laundry treating apparatus.

The control panel 200 can have a top face 220 and a bottom face 230 (see FIG. 12). The front face 210, the side faces 240, the top face 220, and the bottom face 230 can be connected to each other. For example, the side faces 240, the top face 220, and the bottom face 230 can have a shape extending rearward from the front face 210.

The front face 210 of the control panel 200 can be exposed to the outside to define a front face of the laundry treating apparatus 1 with the first front panel 112 and the second front panel 122. The side face 240 of the control panel 200 can be exposed to the outside in the left and right direction Y, and the top face 220 and the bottom face 230 thereof can be inserted between the first front panel 112 and the second front panel 122 and may not be exposed to the outside.

The control panel 200 can be signally connected to at least one of the first treating apparatus 10 or the second treating apparatus 20. The control panel 200 can include (i) a display capable of indicating states of the first treating apparatus 10 and/or the second treating apparatus 20 disposed on the front face 210 thereof and the first treating apparatus 10 and (ii) an input unit capable of inputting operation commands of the first treating apparatus 10 and/or the second treating apparatus 20.

Figure 8:
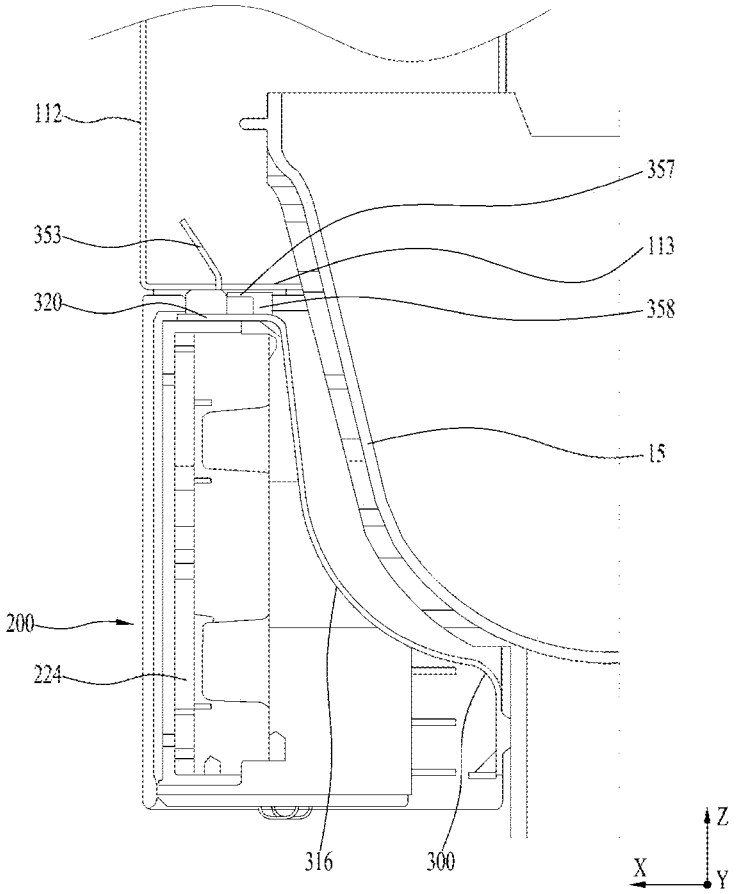
FIG. 8 is a diagram illustrating a cross-sectional view of a lower frame and a control panel coupled to each other in the exemplary laundry treating apparatus.

Electric parts 224 can be arranged inside the control panel 200, that is, on a rear face of the front face 210 (see FIG. 8). The electric parts 224 can be electrically connected to the first treating apparatus 10 and/or the second treating apparatus 20 and can exchange state information or control signals.

For example, the electric parts 224 can include (i) a controller of the first treating apparatus 10 and a controller of the second treating apparatus 20, (ii) an integrated controller that controls the first treating apparatus 10 and the second treating apparatus 20 together, or (iii) a panel controller connected to the controller of the first treating apparatus 10 and the controller of the second treating apparatus 20 in a control manner, or can be controlled by the controller of the first treating apparatus 10 and the controller of the second treating apparatus 20 without a separate controller.

The control panel 200 can include a rear face, and the rear face of the control panel 200 can be opened. The control panel 200 disposed between the first front panel 112 and the second front panel 122 can be positioned at a lower portion of the first treating apparatus 10 or at an upper portion of the second treating apparatus 20.

The control panel 200 can be made of an electrically insulating material such as plastic and the like. For example, the control panel can be manufactured to contain the electrically insulating material, so that the control panel can be inserted between the first front panel 112 and the second front panel 122 to insulate the first front panel 112 and the second front panel 122 from each other. By way of further example, the control panel 200, made of an electrical insulator, can limit an occurrence of malfunction or damage from unintentional electrical connection between the first front panel 112 and the second front panel 122.

Figure 3:
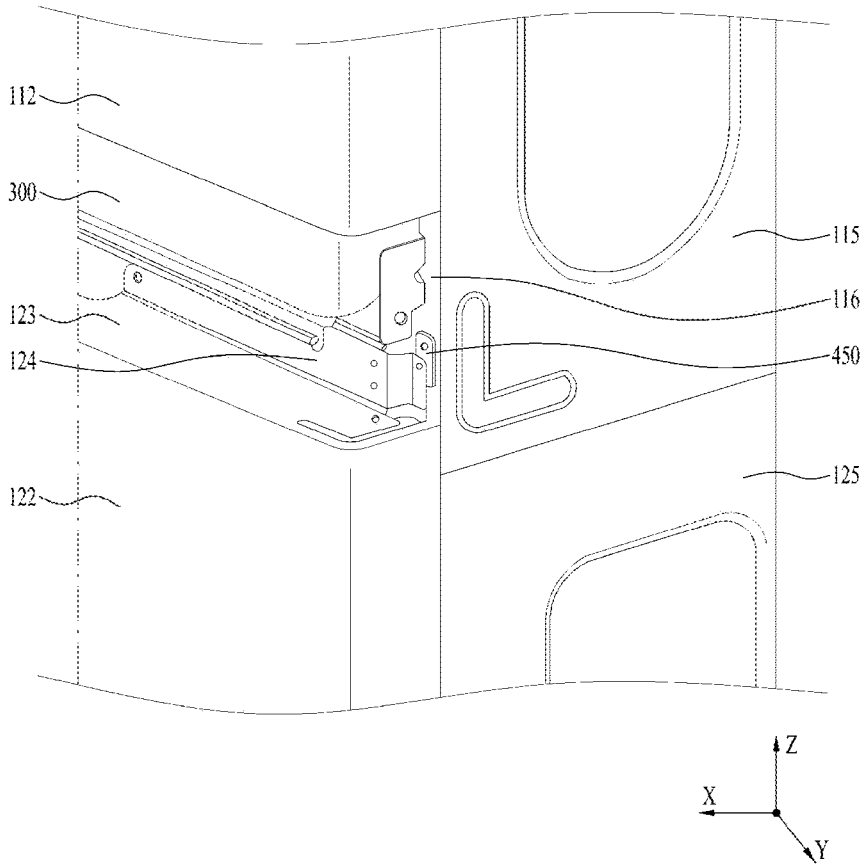
FIG. 3 is a diagram illustrating a view of a coupled state of a lower frame in the exemplary laundry treating apparatus.
Figure 4:
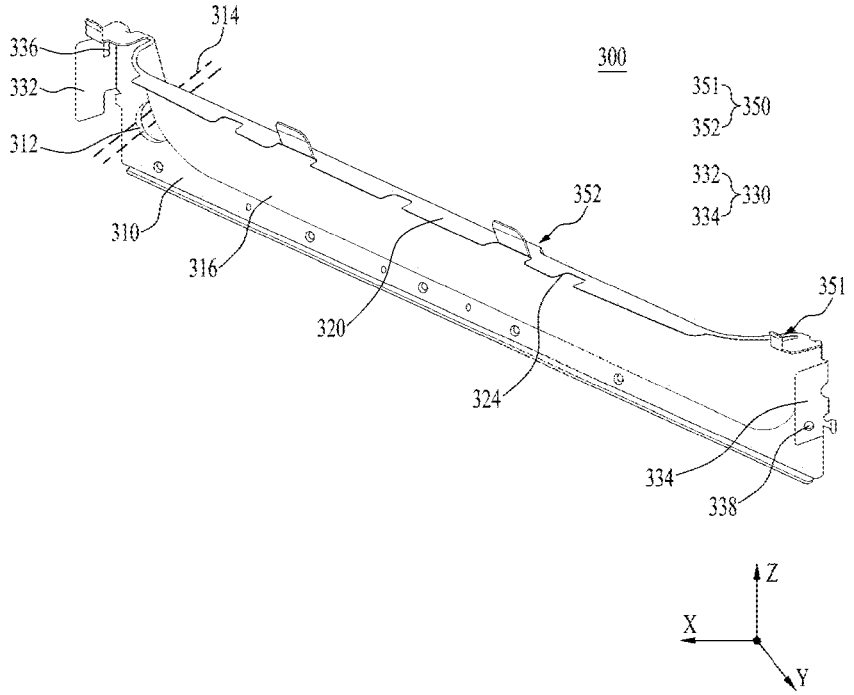
FIG. 4 is a diagram illustrating a perspective view of a lower frame of the exemplary laundry treating apparatus.

For example, FIG. 2 is a diagram illustrating a view of the control panel 200 separated from the laundry treating apparatus 1, FIG. 3 is a diagram illustrating a lower frame 300 coupled to a lower portion of the first treating apparatus 10, and FIG. 4 is a diagram illustrating a perspective view of the lower frame 300.

As shown in FIGS. 2 to 4, the first treating apparatus 10 can include the lower frame 300. The lower frame 300 can be coupled to the control panel 200 at the rear of the control panel 200 to fix the control panel 200.

The lower frame 300 can be constructed to be coupled to and fix the control panel 200 inserted between the first front panel 112 and the second front panel 122. The lower frame 300 can be disposed beneath the first front panel 112 and can be disposed at the rear of the control panel 200.

The lower frame 300 can be coupled with the control panel 200 while being fixed to the first treating apparatus 10. Various schemes of coupling with the control panel 200 will be described later. For example, the side face 240 of the control panel 200 can be coupled with side end extensions 330 of the lower frame 300 to fix the control panel 200.

In some implementations, the first treating apparatus 10 and the second treating apparatus 20 are arranged together such that a user can perform an efficient laundry treating process, and one control panel 200 for efficient operation of the first treating apparatus 10 and the second treating apparatus 20 is disposed between the first front panel 112 and the second front panel 122 to improve ease of use.

In some implementations, the lower frame 300 disposed at the rear of the control panel 200 is disposed at the lower portion of the first treating apparatus 10 such that the control panel 200 disposed between the first front panel 112 and the second front panel 122 can be stably fixed and used. Further, the lower frame 300 and the control panel 200 can be coupled to each other, so that the control panel 200 can be effectively and stably coupled and fixed.

Referring to FIG. 3, both side faces in the left and right direction Y of the lower frame 300 can be respectively coupled to the first side panels 115 respectively facing toward the both side faces of the lower frame 300.

In some implementations, the components can have the front and rear directions X parallel to each other, the left and right directions Y parallel to each other, and the vertical directions Z. For example, the front and rear direction X of the first treating apparatus 10 can be defined identically to the front and rear directions X of the second treating apparatus 20, the control panel 200, the lower frame 300, and the like. Further, the left and right directions Y and the vertical directions Z can also be defined as in the above scheme.

The both side faces in the left and right direction Y of the lower frame 300 can be respectively coupled to the first side panels 115. The lower frame 300 can be disposed at the lower portion of the front face of the first treating apparatus 10, and the both side faces in the left and right direction Y thereof can respectively face toward the first side panels 115 at the rear of the first side panels 115.

Each first side panel 115 can include a front bending portion 116 extending from a front end thereof, and the lower frame 300 can be coupled to the front bending portions 116 of the first side panels 115. As for a coupling scheme, various schemes such as screw coupling, rivet coupling, fitting coupling, and the like can be used.

In some implementations, the lower frame 300 has the both side faces in the left and right direction Y respectively coupled to the first side panels 115, and the control panel 200 disposed at the front is coupled to the lower frame 300, so that the control panel 200 that can be connected to the first treating apparatus 10 and the second treating apparatus 20 between the first front panel 112 and the second front panel 122 can have the stable fixing structure.

For example, referring to FIG. 4, the lower frame 300 can include a main frame face 310. The main frame face 310 can extend along the left and right direction Y of the first treating apparatus 10 and can divide an interior of the first treating apparatus 10 from the control panel 200.

Specifically, the main frame face 310 of the lower frame 300 can be disposed in parallel to the front face 210 of the control panel 200. The main frame face 310 can extend in left and right direction Y, so that both ends thereof can be respectively coupled to the first side panels 115.

The main frame face 310 can be disposed between the interior of the first treating apparatus 10 and an interior of the control panel 200 to divide the interior of the first treating apparatus 10 from the interior of the control panel 200. Inside the first treating apparatus 10, various internals can be arranged, and there can be a large amount of water or a high-temperature air current as needed. In a process of using the first treating apparatus 10, unintended leak may occur, or the air current may affect the process.

Accordingly, the laundry treating apparatus 1 can limit influence of the water or a temperature change inside the first treating apparatus 10 on the control panel 200 as the lower frame 300 includes the main frame face 310 that divides the control panel 200 from the interior of the first treating apparatus 10.

The main frame face 310 can have various shapes as needed, and as described later, can include a convex portion 316 to secure a space in which the internals of the first treating apparatus 10 are arranged and effectively divide the control panel 200 from the interior of the first treating apparatus 10.

In some implementations, a connection hole 312 through which a signal connection line 314 for signally connecting the first treating apparatus 10 with the control panel 200 passes can be defined in the main frame face 310.

The above-described electric parts 224 can be arranged inside the control panel 200, and the electric parts 224 can be connected to a sensor, a motor, the controller of first treating apparatus 10, or the like disposed inside the first treating apparatus 10.

For example, the signal connection line 314 can extend from the interior of the first treating apparatus 10 to the electric parts 224 of the control panel 200, and signal connection between components of the first treating apparatus 10 and the control panel 200 can be achieved by the signal connection line 314.

In some implementations, the control panel 200 can be fixed by the lower frame 300, and the lower frame 300 can include the main frame face 310 that divides the control panel 200 from the interior of the first treating apparatus 10, so that the connection hole 312 through which the signal connection line 314 passes can be defined in the main frame face 310.

The signal connection line 314 can have various shapes. For example, the signal connection line 314 can include a connection jack or a connection port, and can be connected to the electric parts 224 through the connection hole 312.

Figure 5:
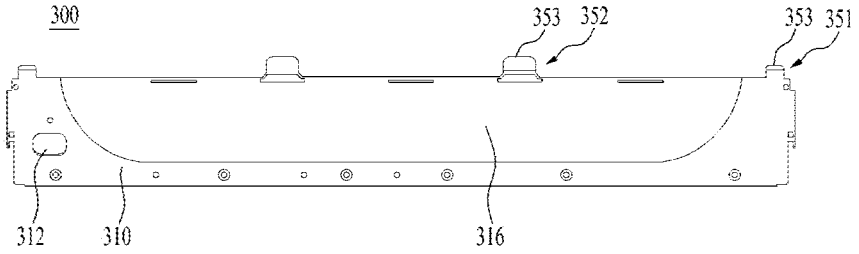
FIG. 5 is a diagram illustrating a front view of a lower frame of the exemplary laundry treating apparatus.

There can also be various positions and shapes of the connection hole 312. FIG. 5 is a diagram illustrating a front view of the lower frame 300. Referring to FIG. 5, the connection hole 312 can be defined on one side in the left and right direction Y of the main frame face 310, and can be defined on a lower side of said one side such that the signal connection line 314 can be effectively connected to the electric parts 224.

Figure 6:
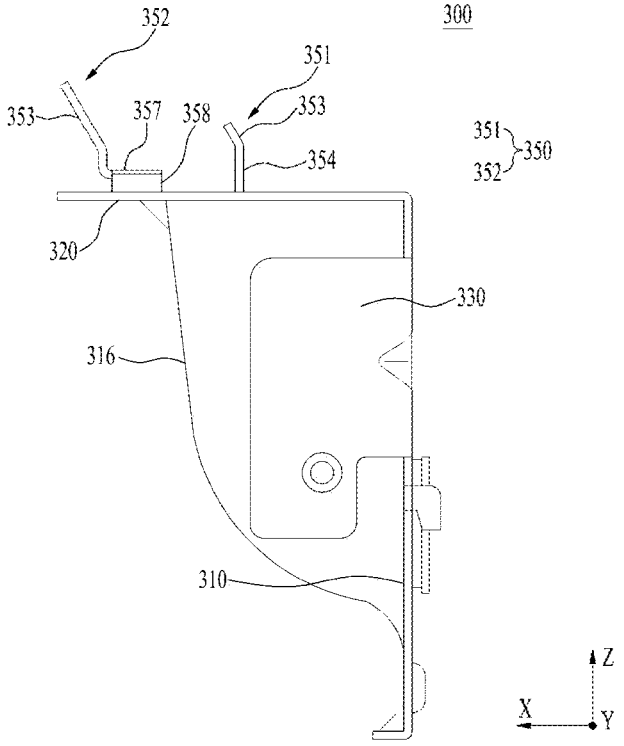
FIG. 6 is a diagram illustrating a side view of a lower frame of the exemplary laundry treating apparatus.

FIG. 6 is a diagram illustrating a side view of the lower frame 300. Referring to FIGS. 4 to 6, the lower frame 300 can further include an upper end extension 320 and a top coupling portion 350.

The upper end extension 320 can extend forward from an upper end of the main frame face 310, and the top coupling portion 350 can protrude upward from the upper end extension 320 and be coupled to the bottom of the first front panel 112.

The upper end extension 320 can extend forward from the upper end of the main frame face 310 and can be positioned below the first front panel 112. The upper end extension 320 can extend along the left and right direction Y like the main frame face 310, and can extend forward from the main frame face 310.

The top coupling portion 350 can be disposed on the upper end extension 320. The top coupling portion 350 can protrude upward from the upper end extension 320 positioned below the first front panel 112 and can be coupled to the bottom of the first front panel 112.

There can be various numbers, positions, and shapes of the top coupling portion 350 or schemes of coupling with the first front panel 112 as needed. For example, the first front panel 112 can include a lower end bending portion 113, and the top coupling portion 350 can include a panel inserted portion 353 inserted into the lower end bending portion 113 (see FIGS. 7 and 8).

Specifically, the first front panel 112 can include the lower end bending portion 113 extending rearward from a lower end thereof. The lower end bending portion 113 can be bent or angled at a lower end of a front face of the first front panel 112.

The lower end bending portion 113 can be disposed in parallel to the upper end extension 320, and the top coupling portion 350 can include a panel inserted portion 353 protruding toward the lower end bending portion 113 to penetrate the lower end bending portion 113.

The panel inserted portion 353 can penetrate the lower end bending portion 113 of the first front panel 112 and can be inserted into the bottom of the first front panel 112. The top coupling portion 350 can be coupled to the first front panel 112 as the panel inserted portion 353 penetrates and can be inserted into the lower end bending portion 113.

In some implementations, the lower frame 300 can be fixed by being coupled to each first side panel 115, can fix the control panel 200 by being coupled to the control panel 200 at the front, can be coupled to the first front panel 112 through the upper end extension 320, and can support the first front panel 112, thereby effectively improving structural stability of the laundry treating apparatus 1.

Figure 7:
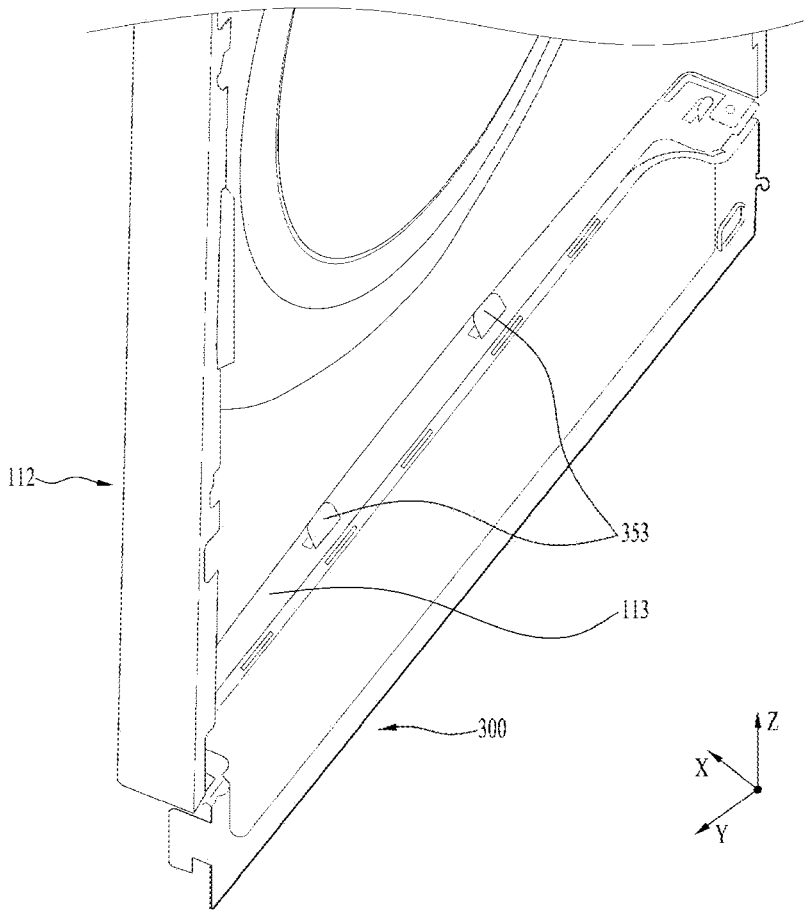
FIG. 7 is a diagram illustrating a view of a coupling structure of a first front panel and a lower frame in the exemplary laundry treating apparatus.

FIG. 7 is a diagram illustrating the panel inserted portion 353 inserted into the lower end bending portion 113 of the first front panel 112, and FIG. 8 is a diagram illustrating a cross-sectional view of the lower frame 300, the control panel, and the first front panel 112 coupled to each other.

Referring to FIGS. 6 to 8, at least a portion of the panel inserted portion 353 can extend in an inclined manner such that an upper end thereof is positioned forwardly of a lower end thereof.

For example, the panel inserted portion 353 can be provided to incline forward upwardly. An inclined portion of the panel inserted portion 353 can be provided on an entirety of or only a portion of the panel inserted portion 353.

As the panel inserted portion 353 extends in the inclined manner, the upper end thereof is disposed close to the front face of the first treating apparatus 10. Accordingly, the lower end bending portion 113 of the first front panel 112 can be moved rearward, so that the panel inserted portion 353 can be easily inserted, and fixation of the first front panel 112 into which the panel inserted portion 353 can be strengthened.

Referring to FIGS. 6 and 8, the upper end extension 320 can be spaced downwardly apart from the first front panel 112, and the top coupling portion 350 can further include an ascending extension 354. The ascending extension 354 can extend from the upper end extension 320 toward the lower end bending portion 113. In some implementations, the panel inserted portion 353 can be disposed at an upper end of the ascending extension 354 to penetrate the lower end bending portion 113.

The first front panel 112, for example, the lower end bending portion 113 of the first front panel 112 and the upper end extension 320 can be spaced apart from each other. The top face 220 of the control panel 200 can be inserted between the upper end extension 320 and the first front panel 112.

The top coupling portion 350 can include the ascending extension 354 extending upward from the upper end extension 320, and the panel inserted portion 353 extending from the ascending extension 354 can be inserted into the first front panel 112.

The top fastening portion can include a first top fastening portion and a second top fastening portion. The ascending extension 354 can be included in the first top fastening portion. For example, in the first top fastening portion, the ascending extension 354 extending from the upper end extension 320 can extend to the lower end bending portion 113 of the first front panel 112, and the panel inserted portion 353 can be disposed on the upper end of the ascending extension 354 and be inserted into the first front panel 112 through the lower end bending portion 113.

The ascending extension can have various shapes or extension directions. For example, FIG. 6 depicts the plate-shaped panel inserted portion 353 extending in an inclined manner forward from the upper end of the plate-shaped ascending extension 354.

In some implementations, the top coupling portion 350 can include a top support 356, and the panel inserted portion 353 can be disposed on the top support 356. For example, the top coupling portion 350 can include a second top coupling portion 352, the second top coupling portion 352 can include the top support 356, and the panel inserted portion 353 can be disposed on the top support 356.

Specifically, the top support 356 can be disposed on the upper end extension 320 and support the lower end bending portion 113. For example, the top support 356 can be constructed such that an upper end thereof is in contact with the lower end bending portion 113 and supports the lower end bending portion 113 upward.

The top support 356 can have a face for supporting the lower end bending portion 113 or can have a protrusion shape to be in contact with the lower end bending portion 113.

When the top support 356 is disposed on the top coupling portion 350, for example, in a case of the second top coupling portion 352 including the top support 356, the panel inserted portion 353 can be disposed on the top support 356 to penetrate the lower end bending portion 113.

That is, the second top coupling portion 352 can be disposed such that the top support 356 is in contact with the lower end bending portion 113 on the upper end extension 320, and the panel inserted portion 353 can be disposed to protrude upward from the top support 356 to penetrate the lower end bending portion 113.

As described above, the top coupling portion 350 can be constructed to include the top support 356 supporting the lower end bending portion 113, so that the bottom of the first front panel 112 can be supported upward by the lower frame 300 and can be structurally stabilized.

In some implementations, as shown in FIG. 6, the top support 356 can include a top support face 357 that is spaced upwardly from the upper end extension 320, and that is disposed to be in parallel to the lower end bending portion 113 and supports the lower end bending portion 113, and the panel inserted portion 353 can extend from the top support face 357.

The top support face 357 can be disposed to be in parallel to the lower end bending portion 113, and can be disposed to be in parallel to the upper end extension 320. For example, the top support face 357 can be in a form offset upward from the upper end extension 320.

In some implementations, the top support face 357 can be in a face-contact with a bottom face of the lower end bending portion 113 to support the first front panel 112.

In some implementations, the top support 356 can further include a top connection portion 358 connecting the top support face 357 and the upper end extension 320 with each other, and the panel inserted portion 353 can be disposed on a front end of the top support face 357 and at least partially extend in an inclined manner such that an upper end thereof is positioned forward of a lower end thereof.

The top support face 357 can have a plate shape and can be disposed in parallel to the lower end bending portion 113, and can have a connection relationship with the upper end extension 320 by the top connection portion 358. For example, in the top support 356, the top support face 357 can be connected to the upper end extension 320 by the top connection portion 358.

The top connection portion 358 can have various shapes. FIGS. 5 to 6 show that the top connection portion 358 can be provided in a substantially plate shape and can extend from one edge of the top support face 357 toward the upper end extension 320.

In some implementations, in a case of the second top coupling portion 352 having the top support 356, the panel inserted portion 353 can extend upward from the front end, that is, a front edge, of the top support face 357. Accordingly, the first front panel 112 can be supported on the top support face 357 while being moved rearward on the top of the lower frame 300, and the panel inserted portion 353 can penetrate and be coupled to the lower end bending portion 113.

In some implementations, the top connection portion 358 can be provided at both side edges and a rear edge of the top support face 357 to stably fix the top support face 357 to the upper end extension 320.

In some implementations, the top coupling portion 350 can include a first top coupling portion 351 having the ascending extension 354 and coupled to the first front panel 112, and a second top coupling portion 352 that supports and fixes the first front panel 112, so that a coupling strength and a support strength between the first front panel 112 and the lower frame 300 can be efficiently determined. The numbers and positions of the first top coupling portion 351 and the second top coupling portion 352 can be variously determined as needed.

FIG. 4 shows that each first top coupling portions 351 is disposed on each of both sides in the left and right direction Y of the upper end extension 320, and second top coupling portions 352 are arranged at a center of the upper end extension 320.

Figure 10:
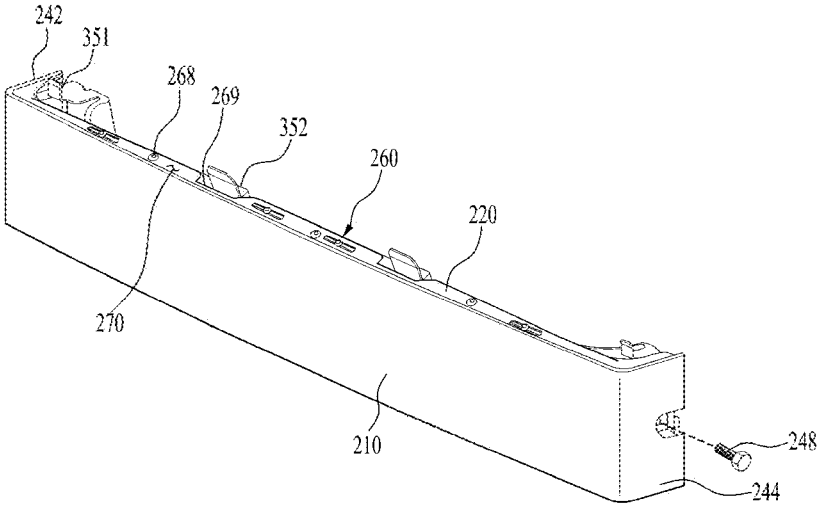
FIG. 10 is a diagram illustrating a view of a control panel coupled to a lower frame in the exemplary laundry treating apparatus.

For example, FIG. 9 is a diagram illustrating the control panel 200 separated from the lower frame 300, and FIG. 10 is a diagram illustrating the lower frame 300 and the control panel 200 of FIG. 9 coupled to each other.

Referring to FIGS. 9 and 10, in the laundry treating apparatus 1, the lower frame 300 can include the side end extensions 330, and the side end extensions 330 can respectively extend forward from both sides of the lower frame 300 to be coupled to the control panel 200.

As described above, the lower frame 300 has the main frame face 310 that divides the control panel 200 from the interior of the first treating apparatus 10, and can include the upper end extension 320 to support and fix the bottom of the first front panel 112.

Furthermore, the side end extensions 330 respectively can extend forward from both sides in the left and right direction Y of the main frame face 310, so that the lower frame 300 can be coupled to the first front panel 112 upward, and at the same time, can be coupled to the control panel 200 in the front through the side end extensions 330, thereby enabling efficient space utilization and realizing a coupling structure.

The side end extension 330 can include a first side end extension 332 disposed on one side in the left and right direction Y of the lower frame 300 and a second side end extension 334 disposed on the other side in the left and right direction Y of the lower frame 300.

In some implementations, the first side end extension 332 can include a hook inserting portion 336 into which a side face hook 246 disposed on the control panel 200 is inserted (see FIG. 11), and the second side end extension 334 can include a through hole 338 coupled to the control panel 200 by a penetrating member 248 that penetrates the control panel 200.

Figure 11:
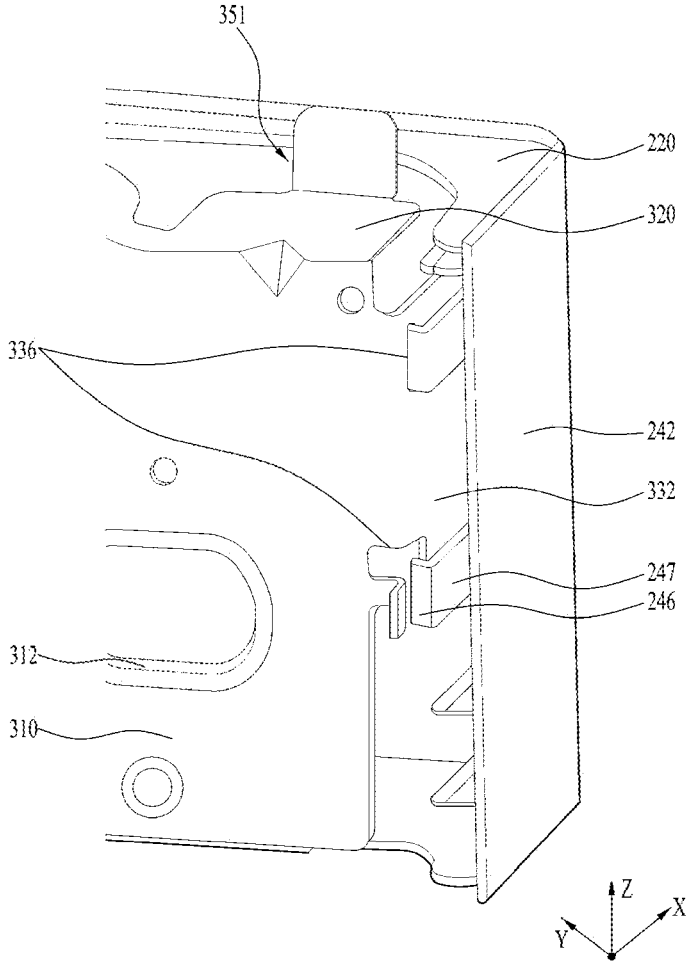
FIG. 11 is a diagram illustrating a view of a side face hook of a control panel in the exemplary laundry treating apparatus.

FIG. 9 shows the second side end extension 334 including the through hole 338 to which the penetrating member 248 is coupled, and FIG. 11 is a diagram illustrating a view of the first side end extension 332 including the hook inserting portion 336 viewed from the rear.

The first side end extension 332 can include the hook inserting portion 336 into which the side face hook 246 disposed on the control panel 200 is inserted. The control panel 200 can include a first side face 242 on one side in the left and right direction Y, and can include the side face hook 246 disposed inside the first side face 242.

Specifically, the first side end extension 332 can be disposed on one side in the left and right direction Y of the main frame face 310 to face toward an inner face of the first side face 242, and the side face hook 246 can be disposed between the first side face 242 and the first side end extension 332.

The side face hook 246 can protrude toward the first side end extension 332 and can be inserted into the hook inserting portion 336 of the first side end extension 332, so that the control panel 200 can be fixed to the lower frame 300.

The side face hook 246 can protrude from one side in the left and right direction Y of the control panel 200 toward the other side and can be inserted into the first side end extension 332 of the lower frame 300.

Figure 13:
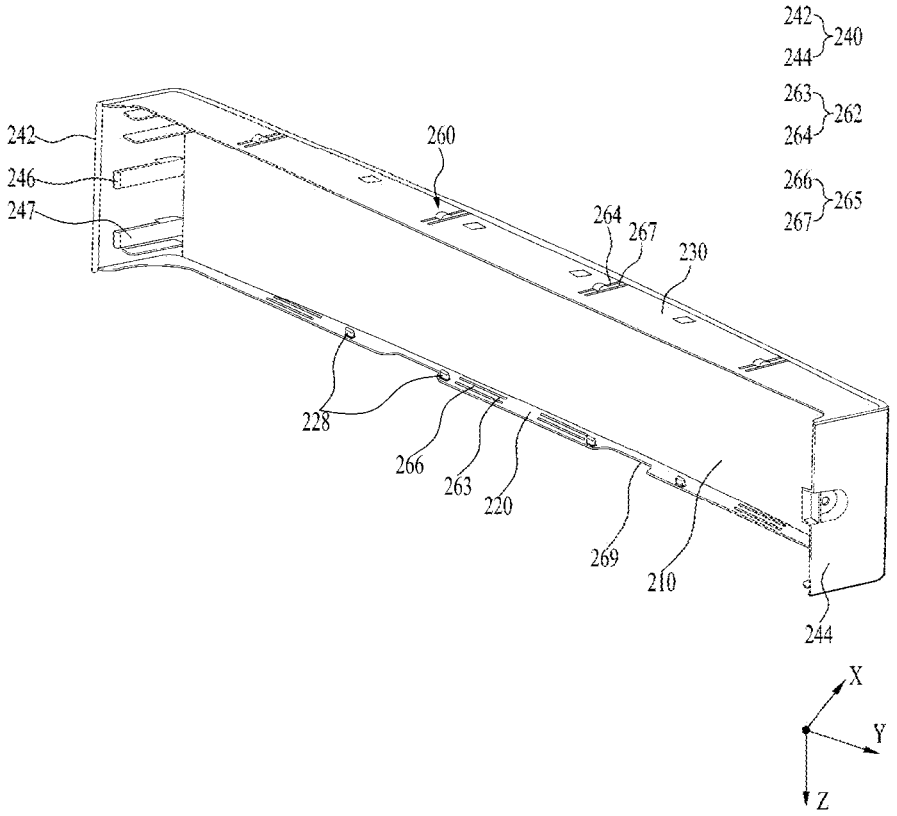
FIG. 13 is a diagram illustrating a perspective view of a control panel of the exemplary laundry treating apparatus viewed from the rear.

In some implementations, the control panel 200 can further include a hook extension 247. For example, FIG. 13 shows the hook extension 247 and the side face hook 246 arranged on an inner face of the first side face 242 of the control panel 200.

The hook extension 247 can extend rearward from the front face 210, can be located between the first side face 242 and the first side end extension 332, can be spaced apart from the first side face 242, and can have the side face hook 246 at an extended end thereof.

The hook extension 247 can extend rearward from the rear face of the front face 210 of the control panel 200, and can be spaced apart from the inner face of the first side face 242, that is, one face of the first side face 242 facing toward the other side in the left and right direction Y of the control panel 200.

As the side face hook 246 and the hook extension 247 are arranged between the first side face 242 of the control panel 200 and the first side end extension 332 of the lower frame 300, and as the side face hook 246 is disposed on an end of the hook extension 247 spaced apart from the first side face 242, during an insertion process of the control panel 200, the hook extension 247 can be bent and deformed as needed such that the side face hook 246 is inserted into the hook inserting portion 336.

For example, when the hook extension 247 is in close contact with the first side face 242 or when the side face hook 246 is disposed on the inner face of the first side face 242, during the insertion process of the control panel 200, the first side face 242 itself of the control panel 200 deforms in a process in which the side face hook 246 reaches the hook inserting portion 336 of the first side end extension 332, resulting in inconvenience in the coupling or a damage.

However, as the side face hook 246 is disposed on the hook extension 247 spaced apart from the first side face 242, during the process of coupling the control panel 200 and the lower frame 300 with each other, the hook extension 247 is partially bent and the side face hook 246 is moved toward the hook inserting portion 336, so that effective coupling can be achieved.

In some implementations, the control panel 200 can have the second side face 244 disposed on the other side in the left and right direction Y, and the side end extension 330 can further include the second side end extension 334. The second side end extension 334 can be disposed on the other side in the left and right direction Y of the main frame face 310 to face toward the inner face of the second side face 244.

The second side face 244 of the control panel 200 can be penetrated by the penetrating member 248, and the second side end extension 334 of the lower frame 300 positioned on the inner face of the second side face 244 can include the through hole 338 into which the penetrating member 248 is coupled.

The through hole 338 can be penetrated by the penetrating member 248 like the second side face 244, or can be coupled to the penetrating member 248 as the penetrating member 248 penetrated the second side face 244 is inserted thereto. The penetrating member 248 can have various shapes such as a screw shape, a rivet shape, or the like.

In some implementations, the first side end extension 332 of the lower frame 300 is coupled to the first side face 242 of the control panel 200 through the hook inserting portion 336, and the second side end extension 334 of the lower frame 300 is coupled to the second side face 244 of the control panel 200 through the through hole 338, so that assembly efficiency can be improved and a structure having excellent coupling stability can be implemented.

For example, when both the first side end extension 332 and the second side end extension 334 of the lower frame 300 are coupled to the control panel 200 in a hook manner through the hook inserting portion 336, compared to the coupling using the penetrating member 248, the coupling stability can be lower, and it may be disadvantageous in separating the control panel 200 when necessary.

In addition, when both the first side end extension 332 and the second side end extension 334 of the lower frame 300 are coupled to the control panel 200 using the penetrating member 248, there is no means for the control panel 200 to be fixed at an appropriate position to be coupled with the lower frame 300, and a process and a component required for the assembly process are added, which may be disadvantageous.

Accordingly, in some implementations, the first side face 242 of the control panel 200 and the first side end extension 332 of the lower frame 300 can be coupled to each other through the side face hook 246 and the hook inserting portions 336, so that the position of the control panel 200 at the beginning of the coupling of the control panel 200 can be effectively fixed.

In addition, the second side face 244 of the control panel 200 and the second side end extension 334 of the lower frame 300 can be coupled to each other through the penetrating member 248 and the through hole 338 in a penetrating manner, so that a stable coupling structure in which coupling and separation can be maintained.

Referring again to FIGS. 4 to 8, the main frame face 310 of the lower frame 300 can include the convex portion 316 that is curved such that a front face of the convex portion 316 is convex and a rear face of the convex portion 316 is concave to define a space at the rear.

The convex portion 316 can have a shape extending along the left and right direction Y of the lower frame 300 so as to be parallel with a longitudinal direction of the main frame face 310. In addition, as the front face of the convex portion 316 is convex and the rear face thereof is concave, the space can be secured at the rear, so that the convex portion 316 and the components inside the first treating apparatus 10 do not interfere with each other.

FIG. 8 shows a base cabinet 15 of the first treating apparatus 10 is disposed at the rear of the main frame face 310 of the lower frame 300. FIG. 8 shows that the convex portion 316 of the main frame face 310 is bent or angled so as to correspond to the base cabinet 15, and thus, a space in which the base cabinet 15 is disposed can be secured without interference between the base cabinet 15 and the lower frame 300 located at the rear. The base cabinet 15 can correspond to the first bottom panel of the first treating apparatus 10 or can be a component included in the first bottom panel.

The convex portion 316 can include the top of the main frame face 310, and the upper end extension 320 can extend from the convex portion 316 (see FIGS. 5 and 6). For example, the convex portion 316 can have a shape in which the space defined at the rear is opened upward.

The convex portion 316 can extend downward from the upper end of the main frame face 310 and can extend along the left and right direction Y. The connection hole 312 can be defined in the convex portion 316 or can be positioned to avoid the convex portion 316.

Because the lower frame 300 has the shape in which the convex portion 316 is provided on the top of the main frame face 310 and the space defined at the rear is opened upward, a space in which the base cabinet 15 and the like that can be positioned at the rear of the lower frame 300 can be effectively secured, and a support strength of the first front panel 112 supported by the upper end extension 320 can be effectively improved.

Figure 14:
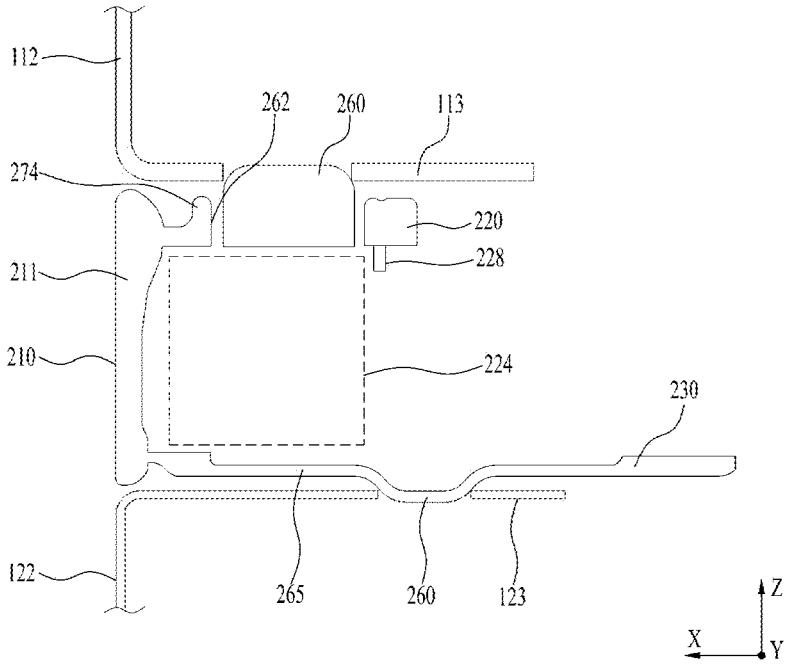
FIG. 14 is a diagram illustrating a cross-sectional view of a coupling structure of a control panel and first and second front face panels in the exemplary laundry treating apparatus.

For example, FIG. 12 is a diagram illustrating a view of the control panel 200 viewed from the top, FIG. 13 is a diagram illustrating a view of the bottom face 230 of the control panel 200 viewed from the rear, and FIG. 14 is a diagram illustrating a cross-section of the control panel 200 coupled to the first front panel 112 and the second front panel 122.

Referring to FIGS. 12 to 14, in the laundry treating apparatus 1, the control panel 200 can be fixed as the top thereof is coupled to the bottom of the first front panel 112 and the bottom thereof is coupled to a top of the second front panel 122.

For example, in the control panel 200, the top face 220 can be coupled to the bottom of the first front panel 112, and the bottom face 230 of the control panel 200 can be coupled to the top of the second front panel 122. As described above, the control panel 200 can provide the stable coupling structure as the side faces 240 are coupled to the lower frame 300, and at the same time, the top face 220 and the bottom face 230 are respectively coupled to the first front panel 112 and the second front panel 122.

The control panel 200 can be coupled to the first front panel 112 and the second front panel 122 in various schemes. For example, the control panel 200 in front of the lower frame 300 can move rearward to be inserted between the first front panel 112 and the second front panel 122. In the insertion process of the control panel 200, panel fastening portions 260 that can be arranged on the top face 220 and the bottom face 230 can be respectively coupled to the first front panel 112 and the second front panel 122.

Referring to FIG. 14, the second front panel 122 can include an upper end bending portion 123 extending rearward from an upper end of a front face of the second front panel 122. The upper end bending portion 123 can be bent from the front face of the second front panel 122.

The top of the control panel 200 can be coupled to the lower end bending portion 113 of the first front panel 112, and the bottom of the control panel 200 can be coupled to the upper end bending portion 123 of the second front panel 122. Specifically, the control panel 200 inserted between the first front panel 112 and the second front panel 122 can be constructed such that the top thereof, that is, the top face 220 faces toward the lower end bending portion 113 of the first front panel 112, and the bottom thereof, that is, the bottom face 230 faces toward the upper end bending portion 123 of the second front panel 122.

The top face 220 of the control panel 200 can be disposed in parallel to the lower end bending portion 113 of the first front panel 112, and the bottom face 230 of the control panel 200 can be disposed in parallel to the upper end bending portion 123 of the second front panel 122. Furthermore, the lower end bending portion 113 of the first front panel 112 and the upper end bending portion 123 of the second front panel 122 can also be arranged in parallel to each other.

In the insertion process of the control panel 200, the top face 220 disposed at the top of the control panel 200 can be coupled to the lower end bending portion 113 of the first front panel 112, and the bottom face 230 disposed at the bottom of the control panel 200 can be coupled to the upper end bending portion 123 of the second front panel 122.

For example, FIG. 12 shows the panel fastening portion 260 disposed on the top face 220 of the control panel 200, and FIG. 13 shows the panel fastening portion 260 disposed on the bottom face 230 of the control panel 200. Referring to FIGS. 12 and 13, the top face 220 and the bottom face 230 can include the panel fastening portions 260 respectively inserted into and coupled to the lower end bending portion 113 and the upper end bending portion 123 respectively facing thereto.

The panel fastening portion 260 can have a hook shape and be coupled to the lower end bending portion 113 or the upper end bending portion 123, or can have a protrusion shape and be inserted into and coupled to the lower end bending portion 113 or the upper end bending portion 123.

FIGS. 12 and 13 show the panel fastening portions 260 that are respectively inserted into and coupled to the lower end bending portion 113 of the first front panel 112 and the upper end bending portion 123 of the second front panel 122 as shown in FIG. 14. The number, a position, and a shape of the panel fastening portion 260 can be various as needed.

For example, each of the top face 220 and the bottom face 230 can include an opening 262 that opens in the vertical direction Z and a fastening elastic portion 265 extending from an inner face of the opening 262 to intersect the opening 262. The panel fastening portion 260 of each of the top face 220 and the bottom face 230 can be disposed on the fastening elastic portion 265.

Specifically, a top face opening 263 can be defined in the top face 220 and a bottom face opening 264 can be defined in the bottom face 230 (see FIG. 13). Each of the top face opening 263 and the bottom face opening 264 can have a shape opening in the vertical direction Z and can penetrate each of the top face 220 and the bottom face 230.

The fastening elastic portion 265 can include a top face fastening elastic portion 266 disposed on the top face 220 and a bottom face fastening elastic portion 267 disposed on the bottom face 230. The top face fastening elastic portion 266 can be disposed to intersect the top face opening 263 of the top face 220, and the bottom face fastening elastic portion 267 can be disposed to intersect the bottom face opening 264 of the bottom face 230.

The fastening elastic portion 265 can extend in parallel with the top face 220 or the bottom face 230 from the inner face of each opening 262. For example, the fastening elastic portion 265 can extend from one side of the inner face of the opening 262 and can be connected to the other side of the inner face of the opening 262.

For example, the fastening elastic portion 265 can be disposed on the opening 262. Both ends of the fastening elastic portion 265 can be connected to the top face 220 or the bottom face 230 of the control panel 200 in a longitudinal direction, and the remaining portion thereof can be separated from the top face 220 or the bottom face 230.

Each opening 262 can have a shape extending in parallel to the longitudinal direction of the fastening elastic portion 265, and can be at least partially shielded in the vertical direction Z by the fastening elastic portion 265.

For example, the fastening elastic portion 265 can be formed by cutting both sides thereof from the top face 220 or the bottom face 230 along the longitudinal direction of the fastening elastic portion 265. Accordingly, the both ends of the fastening elastic portion 265 connected to the inner face of the opening 262 are fixed, so that a center of the fastening elastic portion 265 can be separated from the top face 220 or the bottom face 230 and be elastically deformed.

In some implementations, as the panel fastening portion 260 is disposed on the fastening elastic portion 265, during the insertion process of the control panel 200, the fastening elastic portion 265 can be deformed in a process in which each panel fastening portion 260 is moved toward the lower end bending portion 113 of the first front panel 112 or the upper end bending portion 123 of the second front panel 122, and the fastening elastic portion 265 can be restored as the panel fastening portion 260 reaches each coupling point, so that the coupling structure can be formed.

FIG. 12 shows the top face opening 263 and the top face fastening elastic portion 266 respectively defined in and disposed on the top face 220 of the control panel 200, and FIG. 13 shows the bottom face opening 264 and the bottom face fastening elastic portion 267 respectively defined in and disposed on the bottom face 230 of the control panel 200.

Figure 15:
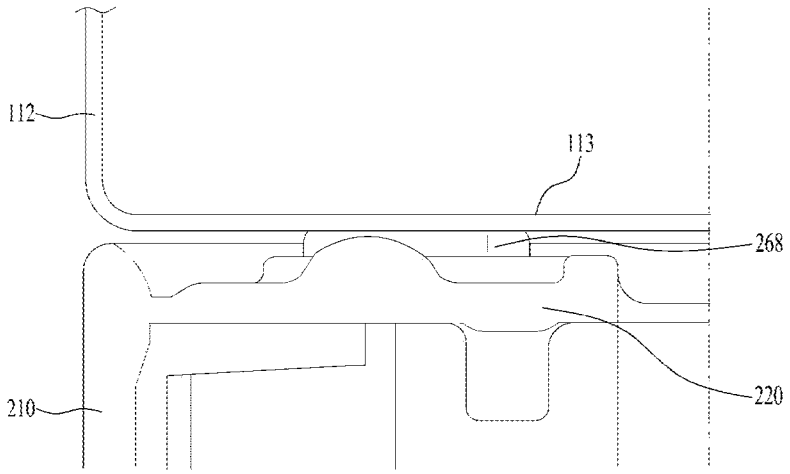
FIG. 15 is a diagram illustrating a view of a panel support of a control panel in the exemplary laundry treating apparatus.

For example, FIG. 12 shows a panel support 268 disposed on the top face 220 of the control panel 200, and FIG. 15 shows the panel support 268 supporting the lower end bending portion 113 of the first front panel 112 from below.

Specifically, the panel support 268 can be distinguished from the panel fastening portion 260, and an upper end of the panel support 268 can upwardly support the lower end bending portion 113 of the first front panel 112. The number and a shape of the panel supports 268 can be various, and the panel support 268 can have a top face parallel to the lower end bending portion 113.

The panel support 268 can protrude upward from the top face 220 of the control panel 200 like the panel fastening portion 260. However, unlike the panel fastening portion 260 inserted into the lower end bending portion 113, the panel support 268 can be in contact with the bottom face of the lower end bending portion 113 to support the lower end bending portion 113. The panel support 268 can have a protrusion shape like the panel fastening portion 260.

In some implementations, as the panel support 268 supporting the bottom of the first front panel 112 is disposed on the top face 220 of the control panel 200, the first front panel 112 can be stably supported. Furthermore, because the panel support 268 of the control panel 200 supports the first front panel 112 together with the top support 356 of the lower frame 300, structural stability can be improved.

In some implementations, the panel fastening portion 260 can have a protrusion height greater than that of the panel support 268. Accordingly, an entirety of the lower end bending portion 113 can have a flat face, and a shape in which the panel fastening portion 260 is inserted into the lower end bending portion 113 of the first front panel 112, and the panel support 268 supports the lower end bending portion 113 can be realized.

Referring to FIGS. 9 and 10, the top face 220 of the control panel 200 can have a coupling portion receiving groove 269 into which the top coupling portion 350 of the lower frame 300 is inserted and received.

Specifically, the top face 220 of the control panel 200 can be inserted between the lower end bending portion 113 and the upper end extension 320, and as described above, the upper end extension 320 can include the top coupling portion 350 protruding upward and inserted into the lower end bending portion 113.

In addition, the top face 220 can include the coupling portion receiving groove 269 that is opened rearward, and the top coupling portion 350 can be inserted into the coupling portion receiving groove 269 from the rear.

The coupling portion receiving groove 269 can have a shape extending in the front and rear direction X in consideration of an insertion direction of the control panel 200, and a width of the coupling portion receiving groove 269 can be greater than that of the top coupling portion 350. A rear end of the coupling portion receiving groove 269 can be disposed to face toward the top coupling portion 350 and opened rearward, so that the top coupling portion 350 can be inserted into the coupling portion receiving groove 269 through the open rear end of the coupling portion receiving groove 269.

For example, in the process in which the control panel 200 in front of the lower frame 300 is moved rearward and inserted, the top coupling portion 350 of the lower frame 300 can move forward from the rear of the coupling portion receiving groove 269 and be inserted into the coupling portion receiving groove 269.

Accordingly, the upper end extension 320 having the top coupling portion 350 coupled to the first front panel 112 and supporting the first front panel 112 can be included in the lower frame 300. In the structure in which the top face 220 of the control panel 200 is inserted between the upper end extension 320 and the lower end bending portion 113 of the first front panel 112, the top coupling portion 350 protruding from the upper end extension 320 of the lower frame 300 toward the lower end bending portion 113 can be positioned without structural interference by the coupling portion receiving groove 269. In addition, the top face 220 of the control panel 200 can also be inserted between the first front panel 112 and the upper end extension 320 of the lower frame 300 without interference by the top coupling portion 350.

For example, FIG. 13 shows an electric parts coupling portion 228 protruding downward from the inner face of the top face 220 of the control panel 200, and FIG. 14 schematically shows the electric parts 224 and the electric parts coupling portion 228.

Referring to FIGS. 13 and 14, the control panel 200 can further include the electric parts 224 and the electric parts coupling portion 228, and the upper end extension 320 of the lower frame 300 can include a front receiving groove 324 into which the electric parts coupling portion 228 is inserted and received.

The electric parts coupling portion 228 can protrude downward from the inner face of the top face 220 and can be coupled to the electric parts 224 inside the control panel 200. The electric parts coupling portion 228 can include a plurality of electric parts coupling portions. The electric parts coupling portion 228 can have a protrusion shape as shown in FIG. 13 and be inserted into and coupled to a groove defined in the electric parts 224, or can be disposed to rearwardly support a rear face of the electric parts 224 as shown in FIG. 14.

In some implementations, the upper end extension 320 of the lower frame 300 can be located below the top face 220 of the control panel 200, and thus, during the insertion process of the control panel 200, the electric parts coupling portion 228 can be in contact with a front end of the upper end extension 320 and interfere with the movement of the control panel 200.

Accordingly, the front receiving groove 324 into which the electric parts coupling portion 228 is inserted and received can be defined at the front end of the upper end extension 320.

The front receiving groove 324 can be defined to face toward the electric parts coupling portion 228. For example, the front receiving groove 324 can be located at the rear of the electric parts coupling portion 228. The front receiving groove 324 can extend in the front and rear direction X in consideration of the coupling direction of the control panel 200, and a front end of the front receiving groove 324 can be opened forward.

During the process in which the control panel 200 is inserted between the first front panel 112 and the second front panel 122, the electric parts coupling portion 228 can be inserted into the front receiving groove 324 through the open front end of the front receiving groove 324. FIG. 9 shows the front receiving groove 324 defined in the upper end extension 320 of the lower frame 300.

In some implementations, as shown in FIG. 14, a length of the top face 220 of the control panel 200 extending rearward from the front face 210 can be less than a length of the bottom face 230 extending rearward from the front face 210, so that the interference with the upper end extension 320 of the lower frame 300 can be limited.

As described above, the top face 220 of the control panel 200 can be disposed adjacent to the upper end extension 320 of the lower frame 300 in the vertical direction Z. The upper end extension 320 of the lower frame 300 can have the top coupling portion 350 coupled to the first front panel 112, and the top face 220 of the control panel 200 can have the electric parts coupling portion 228.

As such, the upper end extension 320 of the lower frame 300 and the top face 220 of the control panel 200 can respectively have components for the coupling and the support in a relationship therebetween, which can cause the structural interference therebetween.

In consideration of the above structural features, the top face 220 of the control panel 200 can be provided to have a smaller length than the bottom face 230, so that the structural interference between the upper end extension 320 of the lower frame 300 and the top face 220 of the control panel 200 can be limited, and structural degrees of freedom therebetween can be effectively improved.

For example, as described above, the top face opening 263 and the top face fastening elastic portion 266 can be respectively defined in and disposed on the top face 220 of the control panel 200, and the bottom face opening 264 and the bottom face fastening elastic portion 267 can be respectively defined in and disposed on the bottom face 230 of the control panel 200.

In addition, referring to FIGS. 12 and 13, the top face fastening elastic portion 266 can be disposed to intersect the top face opening 263 along the left and right direction Y of the control panel 200, and the bottom face fastening elastic portion 267 can be disposed to intersect the bottom face opening 264 along the front and rear direction X of the control panel 200.

For example, the top face fastening elastic portion 266 can extend along the left and right direction Y of the control panel 200, and the bottom face fastening elastic portion 267 can extend along the front and rear direction X of the control panel 200. The top face opening 263 can also extend in the left and right direction Y like the top face fastening elastic portion 266, and the bottom face opening 264 can also extend in the front and rear direction X like the bottom face fastening elastic portion 267.

As described above, at least a portion of the upper end extension 320 of the lower frame 300 can overlap the top face 220 of the control panel 200 and can have a coupling relationship with the first front panel 112 and the like, so that the top face 220 of the control panel 200 can have a length of extending from the front face 210 that is smaller than that of the bottom face 230 to minimize the structural interference with the upper end extension 320.

Accordingly, the top face fastening elastic portion 266 disposed on the top face 220 has a disadvantage in extending in the front and rear direction X because of the small length of the top face 220. Accordingly, the top face fastening elastic portion 266 can extend in the left and right direction Y of the control panel 200. The top face opening 263 can also extend in the left and right direction Y like the top face fastening elastic portion 266.

In addition, because of the characteristics of the bottom face 230 having the larger extension length compared to the top face 220, the bottom face fastening elastic portion 267 disposed on the bottom face 230 can extend in the front and rear direction X unlike the top face fastening elastic portion 266, and the bottom face opening 264 can also extend in the front and rear direction X like the bottom face fastening elastic portion 267. The panel fastening portion 260 can protrude upward from the top face fastening elastic portion 266 and can protrude downward from the bottom face fastening elastic portion.

For example, as depicted in FIG. 12, the laundry treating apparatus 1 can have a drain passage 270 extending in the left and right direction Y on the top face 220 of the control panel 200.

The drain passage 270 can extend along the left and right direction Y on the top face 220, and water falling to the top face 220 can be drained by flowing in the left and right direction Y along the drain passage 270.

Specifically, as described above, the water may exist inside the first treating apparatus 10 and the second treating apparatus 20, such as a washing machine or a condensing dryer, and the water may leak or may be generated in other operating situations of the first treating apparatus 10.

The water may fall along the first treating apparatus 10 or may be supplied to the control panel 200 in other schemes. As described above, the control panel 200 can have the display and the manipulation unit on the front face thereof, and can have the electric parts 224 therein. Therefore, it is necessary to block the water existing on the control panel 200 from flowing into the control panel 200 or flowing along the front face 210.

Accordingly, the control panel can define the drain passage 270 on the top face 220, and the inflow of the water supplied to the top face 220 of the control panel 200 to the front face 210 or the interior of the control panel 200 can be minimized through the drain passage 270.

In addition, because the control panel 200 is located below the first front panel 112, in consideration of the situation in which the water flowing downward along the first front panel 112 falls to the top face 220 of the control panel 200, the drain passage 270 can be defined on the top face 220 of the control panel 200.

The drain passage 270 can have various shapes, and can be provided in various schemes as necessary. FIG. 12 shows the drain passage 270 opened upward and disposed on the top face 220.

The drain passage 270 can extend along the left and right direction Y of the control panel 200. Accordingly, the water falling to the top face 220 may flow in the left and right direction Y on the top face 220, and a phenomenon in which the water passes the rear end of the top face 220 and flows into the control panel 200 or flows along the front face 210 of the control panel 200 can be suppressed.

For example, referring to FIG. 12 along with FIG. 9, the upper end 211 of the front face 210 is located above the top face 220. The top face 220 can have a passage rib 272 protruding upward and extending in the left and right direction Y at a rear end thereof. The drain passage 270 can be provided by the upper end 211 of the front face 210 and the passage rib 272.

Specifically, the top face 220 of the control panel 200 can extend rearward from the upper end of the front face 210, and the upper end 211 of the front face 210 can be positioned higher than the top face 220. For example, the top face 220 can extend rearward from the front face 210 at a vertical level lower than that of the upper end 211 of the front face 210. By way of further example, the front face 210 can extend upward such that the upper end 211 is positioned higher than the top face 220.

In some implementations, the passage rib 272 protruding upward and extending along the left and right direction Y can be disposed at the rear end of the top face 220. The top face 220 can extend in the left and right direction Y of the control panel 200 like the front face 210, and the passage rib 272 can also extend in the left and right direction Y along the top face 220.

In addition, as described above, the top face 220 can have the coupling portion receiving groove 269 defined therein that is opened rearward at the rear end thereof. A specific extending shape of the passage rib 272 can correspond to a shape of the rear end of the top face 220. For example, the passage rib 272 can extend along the rear end of the top face 220.

The drain passage 270 can be defined on the top face 220 by the upper end 211 and the passage rib 272 of the front face 210.

For example, the upper end of the front face 210 can provide one side wall of the drain passage 270, the passage rib 272 can provide an opposite side wall to said one side wall of the drain passage 270, and the top face of the top face 220 can provide a bottom face of the drain passage 270 to define the drain passage 270.

In some implementations, the drain passage 270 can be provided on an entirety of the top face of the top face 220. Accordingly, the water falling to or flowing to the top face 220 may be entirely located in the drain passage 270, or can be drained by flowing in the left and right direction Y along the drain passage 270.

In some implementations, an upper end 241 of each side face 240 of the control panel 200 can be located above the top face 220, and both ends of the passage rib 272 in the left and right direction Y can be respectively spaced apart from the side faces 240 respectively facing thereto, so that each drainage 276 can be defined between the upper end 241 of each side face 240 and the passage rib 272.

Specifically, each side face 240 extending rearward from each of both sides in the left and right direction Y of the front face 210 can have the upper end 241 positioned higher than the top face 220 like the front face 210. The upper end 211 of the front face 210 and the upper end 241 of the side face 240 can extend integrally. Accordingly, the top face 220 can be disposed such that the front end and both side ends thereof are surrounded by the upper end 211 of the front face 210 and the upper end 241 of the side face 240.

Both side ends of the passage rib 272 in the left and right direction Y can be respectively spaced apart from the upper ends of the side faces 240 respectively facing thereto. For example, in the drain passage 270, an opening can be defined between each side end of the passage rib 272 and the upper end of each side face 240 to define the drainage 276. The water present on the top face 220 can be discharged from the top face 220 through the drainage 276.

For example, both sides in the left and right direction Y of the electric parts 224 that can be arranged inside the control panel 200 can be respectively spaced apart from the inner faces of the side faces 240 by a predetermined distance so as to be limited from contacting the water discharged through the drainage 276.

As described above, by the drain passage 270 defined by the upper end of the front face 210 and the upper ends of the side faces 240, the water falling on the top face 220 can be blocked from leaking to the outside along the front face 210 or the side faces 240, and can be discharged rearward from the both sides in the left and right direction Y of the control panel 200 through the drainages 276 respectively defined between the passage rib 272 and the side faces 240.

In addition, as shown in FIG. 12, the panel support 268 and the panel fastening portion 260 arranged on the top face 220 of the control panel 200 can be located in the drain passage 270. As described above, the panel support 268 can be disposed on the drain passage 270 to support the lower end bending portion 113 of the first front panel 112, and the panel fastening portion 260 can be disposed on the drain passage 270 and penetrate the lower end bending portion 113.

The panel support 268 and the panel fastening portion 260 can respectively include a plurality of panel supports and a plurality of panel fastening portions, can be arranged in left and right direction Y along the drain passage 270, and can be arranged to alternate with each other. Accordingly, a supporting force of the first front panel 112 by the panel support 268 and a fixing force of the first front panel 112 by the panel fastening portion 260 can be properly mixed and dispersed.

For example, the top face 220 can further include an inflow prevention rib 274. The inflow prevention rib 274 can extend to surround the opening 262 defined in the top face 220 and protrude upward to prevent the water from flowing into the opening 262. The opening 262 can be the top face opening 263 on which the top face fastening elastic portion 266 is disposed.

The panel fastening portion 260 can be disposed in the drain passage 270 and can be disposed on the fastening elastic portion 265 disposed with the opening 262. For example, the opening 262 on which the fastening elastic portion 265 is provided can be defined in the drain passage 270, and the water on the top face 220 may fall into the control panel 200 through the opening 262.

Accordingly, the inflow prevention rib 274 surrounding the opening 262 can be provided on the top face 220 to limit the water leakage through the opening 262.

The inflow prevention rib 274 can extend in a ring shape to surround a circumference of the opening 262. The ring shape can be various depending on the shape of the opening 262, and can have, for example, a polygonal or circular cross-section.

As a result, while being limited from flowing into the opening 262 by the inflow prevention rib 274, the water on the drain passage 270 defined by the upper end of the front face 210 and the passage rib 272 can flow in the left and right direction Y along the drain passage 270 and be drained.

For example, as described above, the coupling portion receiving groove 269 can be defined in the top face 220. The passage rib 272 extending along the rear end of the top face 220 can be extended to correspond to the coupling portion receiving groove 269, so that the water leakage into the coupling portion receiving groove 269 can be limited.

A portion of the passage rib 272 extending along the coupling portion receiving groove 269 can extend to correspond to the shape of the coupling portion receiving groove 269. For example, FIG. 12 shows the passage rib 272 that extends by being bent or curved to correspond to the coupling portion receiving groove 269 having an approximately rectangular cross-section.

Figure 16:
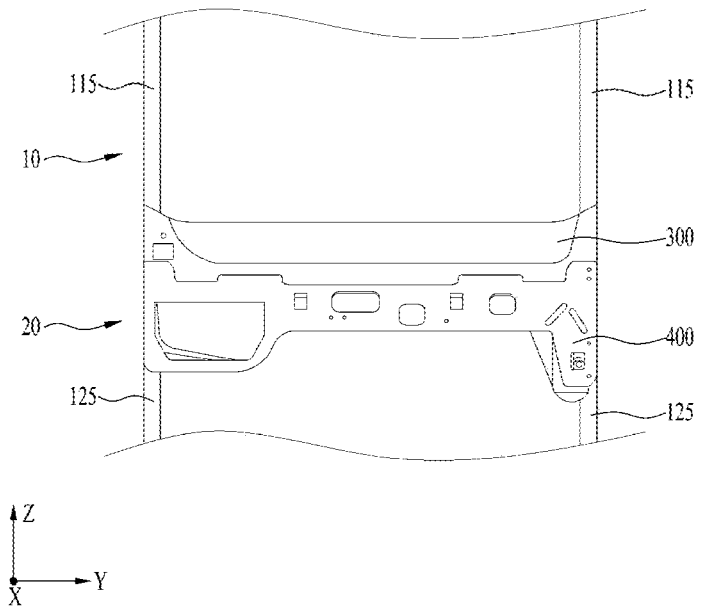
FIG. 16 is a diagram illustrating a view of a lower frame and an upper frame in the exemplary laundry treating apparatus.
Figure 17:
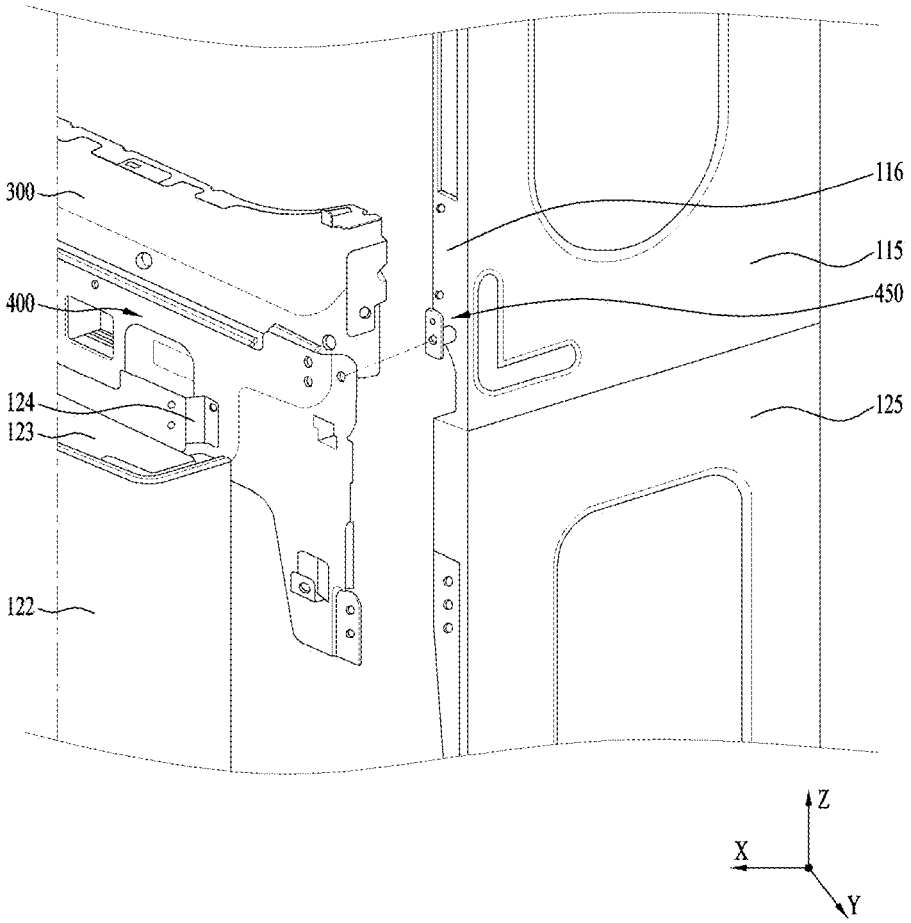
FIG. 17 is a diagram illustrating a view of a lower frame and an upper frame being separated from the exemplary laundry treating apparatus.

FIG. 16 is a diagram illustrating the laundry treating apparatus 1 including a lower frame 300 of the first treating apparatus 10 and an upper frame 400 of the second treating apparatus 20. FIG. 17 is a diagram illustrating an exploded perspective view of the lower frame 300 and the upper frame 400.

Referring to FIGS. 16 and 17, the laundry treating apparatus 1 can include the upper frame 400. The upper frame 400 can be disposed on a rear face of the second front panel 122, and can be coupled to the first side panels 115 through insulating connection members 450 made of an electrically insulating material, so that the upper frame 400 can be electrically insulated from the first side panels 115.

Specifically, the upper frame 400 can be located at a top of the front face of the second treating apparatus 20, and can be coupled to the first treating apparatus 10 to fasten the first treating apparatus 10 and the second treating apparatus 20 to each other.

The upper frame 400 can be disposed on the rear face of the second front panel 122, and can be disposed in front of the second top panel and the second side panels 125 of the second treating apparatus 20 as shown in FIG. 17. For example, the upper frame 400 can be disposed between the second front panel 122 and each second side panel 125.

FIG. 16 shows a detergent opening penetrated by a detergent storage unit for supplying detergent can be defined in the second treating apparatus 20. For example, as shown in FIG. 16, the second treating apparatus 20 can correspond to the washing machine that treats the laundry using the detergent, and the detergent opening penetrated by the detergent storage unit can be defined in the upper frame 400.

The upper frame 400 can be coupled with the second side panels 125 respectively on the both sides in the left and right direction Y, and can be coupled to the second front panel 122 at the front. The upper frame 400 can contribute to improving structural stability and stiffness of the top of the second treating apparatus 20.

The upper frame 400 can be fixed to the second treating apparatus 20, and an upper portion thereof extending upward can be coupled to the lower portion of the first treating apparatus 10. The upper frame 400 can have a face parallel to the second front panel 122 and can be disposed on the front face of the second treating apparatus 20.

In some implementations, the first treating apparatus 10 and the second treating apparatus 20 can correspond to apparatuses that are independent of each other, and can respectively have components that use electricity, such as the motor, the controller, or the like, therein.

When a situation in which the electricity leaks from one of the first treating apparatus 10 and the second treating apparatus 20 occurs, it is necessary to limit the leaked electricity from affecting the other.

For example, the first treating apparatus 10 and the second treating apparatus 20 need to be electrically insulated from each other, so that electric leakage does not occur therebetween.

Accordingly, the laundry treating apparatus 1 can use the insulating connection member 450 for fastening the upper frame 400 of the second treating apparatus 20 with the first treating apparatus 10, and the upper frame 400 can be connected to the first treating apparatus 10 through the insulating connection member 450.

The insulating connection member 450 can be made of the electrically insulating material. The electrically insulating material can be selected as various materials based on needs, such as a plastic material, a rubber material, a mixed material of the plastic and the rubber, or the like.

The upper frame 400 can have a coupling relationship with the first front panel 112 or the first side panels 115 of the first treating apparatus 10 or other components of the first treating apparatus 10, and can be fastened to the first treating apparatus 10 through the insulating connection member 450.

For example, the insulating connection member 450 can insulate the upper frame 400 and the first treating apparatus 10 from each other while coupling the upper frame 400 to the component of the first treating apparatus 10. FIGS. 16 and 17 show the upper frame 400 coupled to the first side panels 115 of the first treating apparatus 10 and insulated from the first side panels 115 through the insulating connection members 450.

The insulating connection member 450 can have various shapes, and can fasten the first treating apparatus 10 to the upper frame 400 in various fastening schemes. For example, the insulating connection member 450 can have the various fastening schemes, such as being formed in a hook shape, including a coupling member inserted therein, or being adhered to one face of the upper frame 400.

In some implementations, as shown in FIG. 17, in the upper frame 400, lower portions of both side portions in the left and right direction Y may be respectively coupled to the second side panels 125, and upper portions of the both side portions can be respectively coupled to the first side panels 115 through the insulating connection members 450.

The upper frame 400 can have a face parallel to the front face of the second front panel 122, and can extend in the left and right direction Y, so that at least portions of the both side portions in the left and right direction Y can be arranged in front of the second side panels 125.

The lower portions of the both side portions of the upper frame 400 can be respectively coupled to the second side panels 125, and the upper portions of the both side portions can be respectively coupled to the first side panels 115. For example, the both sides in the left and right direction Y of the upper frame 400 can be coupled together to the first front panel 112 of the first treating apparatus 10 and the second front panel 122 of the second treating apparatus 20.

The coupling scheme of the upper frame 400 can be various. For example, a hook can be provided on the upper frame 400 and coupled to the first front panel 112 and/or the second front panel 122, and the upper frame 400 can be coupled to the first front panel 112 and/or the second front panel 122 through the coupling member such as a screw or the like as shown in FIG. 17.

Figure 18:
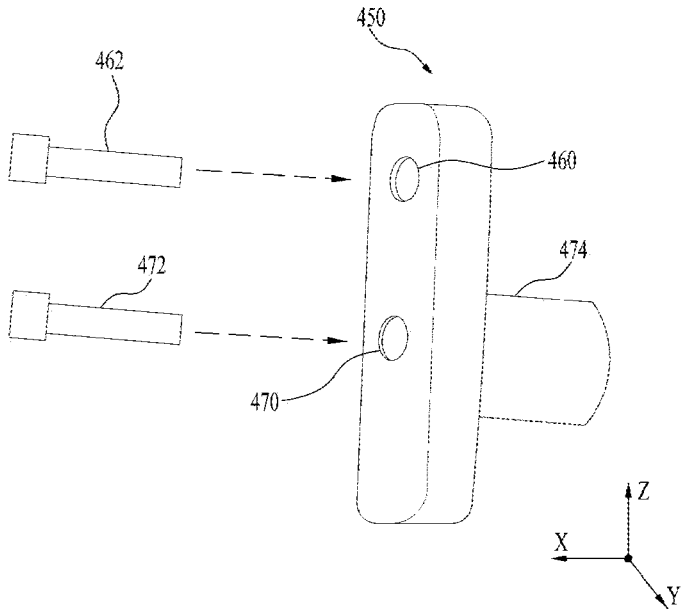
FIG. 18 is a diagram illustrating a view of an insulating connection member in the exemplary laundry treating apparatus.
Figure 19:
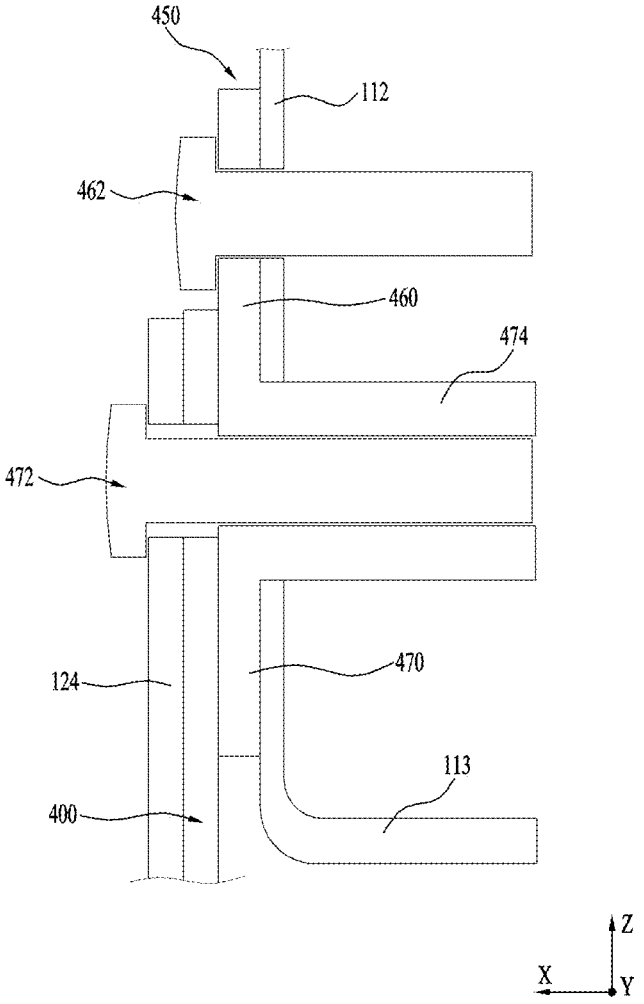
FIG. 19 is a diagram illustrating a cross-sectional view of a coupling structure of an insulating connection member and an upper frame in the exemplary laundry treating apparatus.

For example, FIG. 17 shows each insulating connection member 450 that couples the upper frame 400 and each first side panel 115 with each other, and FIG. 18 is a diagram illustrating a perspective view of the insulating connection member 450. FIG. 19 is a diagram illustrating a cross-sectional view of the coupling structure of each first side panel 115, the insulating connection member 450, and the upper frame 400.

Referring to FIGS. 17 to 19, each insulating connection member 450 can include a first fastening portion 460 and a second fastening portion 470 defined therein. The first fastening portion 460 can be coupled to the first side panel 115, the second fastening portion 470 can be coupled to the upper frame 400, and the second fastening portion 470 can insulate the upper frame 400 and the first side panel 115 from each other.

For example, the insulating connection member 450 can have the first fastening portion 460 and the second fastening portion 470 connected to each other. The insulating connection member 450 can be fixed to the first side panel 115 as the first fastening portion 460 is coupled to the first side panel 115.

In some implementations, the upper portions of the both side portions of the upper frame 400 can be respectively coupled to the second fastening portions 470, and thus, the upper frame 400 can be fixed to the insulating connection members 450. For example, the upper frame 400 is fixed to the insulating connection members 450, and the insulating connection members 450 are respectively fixed to the first side panels 115, thereby the fixing structure of the coupling structure between the upper frame 400 and the first side panel 115 can be provided.

The coupling scheme between the first fastening portion 460 and the first side panel 115 and the coupling scheme between the second fastening portion 470 and the upper frame 400 can be variously determined as needed. For example, a fitting coupling, a hook coupling, or the like can be used, or the coupling relationship can be formed through a fastening member penetrating the insulating connection member 450 as shown in FIGS. 18 and 19.

The upper frame 400 can be coupled to the first side panels 115 through the insulating connection members 450 made of the electrically insulating material, so that the insulation between the upper frame 400 and the first side panels 115 can be achieved by the insulating connection members 450.

For example, as shown in FIG. 19, the second fastening portion 470 of the upper frame 400 can be positioned between the upper frame 400 and the first side panel 115 to limit direct contact between the upper frame 400 and the first side panel 115, thereby insulating the upper frame 400 and the first side panel 115 from each other.

In some implementations, the first fastening portion 460 can extend upward from the second fastening portion 470 coupled to the upper frame 400, and the upper frame 400 coupled to the second fastening portion 470 can be fastened to the first side panel 115 through the first fastening portion 460.

The both side portions of the upper frame 400 extending upward from the second treating apparatus 20 can be respectively coupled to the second fastening portions 470, and the first fastening portions 460 can be respectively coupled to the first side panels 115 while being respectively coupled to the second fastening portions 470, so that the first fastening portion 460 can be located above the second fastening portion 470.

For example, the first fastening portion 460 located at an upper portion of each insulating connection member 450 can be coupled to each first side panel 115, and the second fastening portion 470 located at a lower portion of each insulating connection member 450 can be coupled to the upper frame 400 while facing each side portion of the upper frame 400.

By way of further example, the first fastening portion 460 can be defined to extend upward from the second fastening portion 470, and the second fastening portion 470 can be defined to extend downward from the first fastening portion 460.

In some implementations, the laundry treating apparatus 1 can further include a first fastening member 462 and a second fastening member 472. The first fastening member 462 can penetrate the first fastening portion 460 and the first side panel 115 together to fasten the first fastening portion 460 with the first side panel 115, and the second fastening member 472 can penetrate the upper frame 400 and be inserted into the second fastening portion 470 to fasten the upper frame 400 with the second fastening portion 470. The second fastening portion 470 can insulate the second fastening member 472 and the first side panel 115 from each other.

For example, each insulating connection member 450 can be coupled to each first side panel 115 and the upper frame 400 through each first fastening member 462 and each second fastening member 472. The first fastening member 462 can have a shape of a screw, a rivet, or the like, and can penetrate the first fastening portion 460 and the first side panel 115 together.

Because the first fastening member 462 is not directly in contact with the upper frame 400, the first fastening portion 460 does not need to insulate the first fastening member 462 and the first side panel 115 from each other.

In some implementations, the upper frame 400 can be penetrated by the second fastening member 472, and the second fastening member 472 penetrating the upper frame 400 can be coupled to the second fastening portion 470 of the insulating connection member 450. In this connection, the second fastening portion 470 can be defined to insulate the second fastening member 472 and the first side panel 115 from each other.

The second fastening member 472 that may penetrate the upper frame 400 and may be in contact with and electrically connected to the upper frame 400 needs to be electrically insulated from the first side panel 115. Accordingly, the insulating connection member 450 can be constructed such that the second fastening portion 470 insulates the second fastening member 472 and the first side panel 115 from each other.

There can be various schemes of insulating, by the second fastening portion 470, the second fastening member 472 and the first side panel 115 from each other. For example, the second fastening portion 470 can be disposed in front of the first side panel 115, and the second fastening member 472 can be inserted into and coupled to only the second fastening portion 470 excluding the first side panel 115 in the state of penetrating the upper frame 400, so that the second fastening member 472 can be insulated from the first side panel 115.

Alternatively, as shown in FIGS. 18 to 19, the second fastening portion 470 can be defined to surround the second fastening member 472 to insulate the first side panel 115 and the second fastening member 472 from each other.

In some implementations, as shown in FIGS. 17 to 19, the second fastening portion 470 can include a fastening insulating portion 474. The fastening insulating portion 474 can extend to penetrate the first side panel 115, at least a portion of the second fastening member 472 can be inserted into the fastening insulating portion 474, and the fastening insulating portion 474 can insulate the second fastening member 472 and the first side panel 115 from each other.

The fastening insulating portion 474 can have a hollow shape, and can extend along an insertion direction of the second fastening member 472 to penetrate the first side panel 115. For example, the second fastening member 472 can be constructed to penetrate the upper frame 400 and the first side panel 115 together, and a portion of the second fastening member 472 penetrating the first side panel 115 can be surrounded by the fastening insulating portion 474.

The second fastening member 472 penetrating the upper frame 400 can penetrate the second fastening portion 470 and can be inserted into and coupled to the fastening insulating portion 474. The second fastening member 472 can penetrate the upper frame 400 or the first side panel 115 in the longitudinal direction like the screw or the rivet.

The second fastening member 472 can be coupled to the second fastening portion 470 while having a length of penetrating the first side panel 115 together with the upper frame 400 by the fastening insulating portion 474, so that the coupling force can be improved. Because the second fastening member 472 is eventually inserted into and coupled to the fastening insulating portion 474 of the second fastening portion 470, the insulation between the first side panel 115 and the second fastening member 472 can be achieved. Accordingly, the upper frame 400 that may be electrically connected to the second fastening member 472 can be insulated from the first side panel 115.

The fastening insulating portion 474 can have a shape in which an extended end thereof is sealed to receive the second fastening member 472 in the fastening insulating portion 474, or have a shape in which the extended end is opened and an end of the second fastening member 472 is exposed to the outside of the fastening insulating portion 474.

The fastening insulating portion 474 can be constructed to surround at least a portion of the second fastening member 472 that is positioned parallel to the first side panel 115 to receive at least a portion of the second fastening member 472 therein, and can insulate the first side panel 115 and the second fastening member 472 from each other. The first fastening member 462 and the second fastening member 472 can be separated apart from each other to be electrically separated from each other.

In some implementations, each first side panel 115 can include the front bending portion 116 at the front end thereof. The fastening insulating portion 474 can penetrate the front bending portion 116.

For example, the front end of each first side panel 115 can be located adjacent to the first front panel 112, and the front bending portion 116 of each first side panel 115 can extend in the left and right direction Y from the front end of each first side panel 115.

In some implementations, the front bending portion 116 of each first side panel 115 can be disposed parallel to the front face of the first front panel 112. The first side panel 115 disposed on one side in the left and right direction Y of the first treating apparatus 10 can include the front bending portion 116 extending toward the other side in the left and right direction Y, and the first side panel 115 disposed on the other side in the left and right direction Y of the first treating apparatus 10 can include the front bending portion 116 extending toward said one side in the left and right direction Y.

In some implementations, the front bending portion 116 of the first side panel 115 can extend from a front end of a side face of the first side panel 115 forming the side face of the first treating apparatus 10 to the interior of the first treating apparatus 10. The front bending portion 116 can be provided by being bent or curved at the side face of the first side panel 115.

The front bending portion 116 can have a face parallel to the first front panel 112, and the first fastening member 462 and the second fastening portion 470 can have lengths in the front and rear direction X and can penetrate the front bending portion 116 along the front and rear direction X.

The insulating connection member 450 and the upper frame 400 can be located in front of the front bending portion 116 of the first side panel 115, and the fastening insulating portion 474 can extend rearwardly from the second fastening portion 470 to penetrate the front bending portion 116.

For example, as shown in FIG. 19, the second fastening member 472 can penetrate the upper frame 400, the second fastening portion 470, and the front bending portion 116 of the second side panel 125 in order. At least the portion of the second fastening member 472 can be inserted into the fastening insulating portion 474 of the second fastening portion 470 and can be coupled to the second fastening portion 470.

The second fastening portion 470 has the fastening insulating portion 474 penetrating the second side panel 125, so that the coupling force between the insulating connection member 450 and the first side panel 115 can be strengthened, and the coupling force between the second fastening member 472 and the second fastening portion 470 can also be strengthened, thereby improving the structural stability.

In some implementations, as shown in FIG. 17, the second front panel 122 can further include an upper fastening portion 124. The upper fastening portion 124 can be penetrated together with the upper frame 400 by the second fastening member 472 to be fastened to the second fastening portion 470. FIG. 19 shows a coupling structure from which the upper fastening portion 124 is omitted.

Referring to FIG. 17, the upper fastening portion 124 can be disposed above the second front panel 122, and the upper fastening portion 124 can be disposed on the upper end bending portion 123 of the second front panel 122. For example, the upper fastening portion 124 can have a shape extending upward from a rear end of the upper end bending portion 123 extending rearward from the upper end of the second front panel 122.

The upper fastening portion 124 can be overlapped with the upper frame 400 and the insulating connection member 450 in the front and rear direction X, and the second fastening member 472 can penetrate the upper fastening portion 124 of the second front panel 122, the upper frame 400, the insulating connection member 450, and the first side panel 115 in order and be coupled to the second fastening portion 470 of the insulating connection member 450. In some implementations, the upper fastening portion 124 can be electrically connected to the second fastening member 472 and the upper frame 400.

Because the second front panel 122 forms a coupling relationship with each first side panel 115 by the upper fastening portion 124, the fixing force of the second front panel 122 can be improved, and at the same time, the fastening structure between the first treating apparatus 10 and the second treating apparatus 20 can also reinforced, which are advantageous.

In some implementations, as shown in FIG. 17, the lower frame 300 of the first treating apparatus 10 is coupled to each first side panel 115 together with the upper frame 400. Portions of the lower frame 300 and the upper frame 400 connected to each first side panel 115 can be spaced apart from each other, so that the lower frame 300 and the upper frame 400 can be electrically separated from each other.

For example, a position of the portion of the upper frame 400 coupled to the first side panel 115, that is, the insulating connection member 450 can be located below a position of the portion of the lower frame 300 coupled to the first side panel 115, so that the upper frame 400 can be spaced apart from the lower frame 300.

Accordingly, at the same time when the coupling between the lower frame 300 and the first side panel 115 is achieved, the coupling between the upper frame 400 and the first side panel 115 can be achieved. In addition, the upper frame 400 can be coupled to the first side panel 115 through the insulating connection member 450 and can be spaced apart from and electrically separated from the lower frame 300. Thus, not only the structural stability of each of the first treating apparatus 10 and the second treating apparatus 20, but also the fastening force between the first treating apparatus 10 and the second treating apparatus 20 can be effectively improved, so that the electrical insulation therebetween can be effectively achieved.

Figure 20:
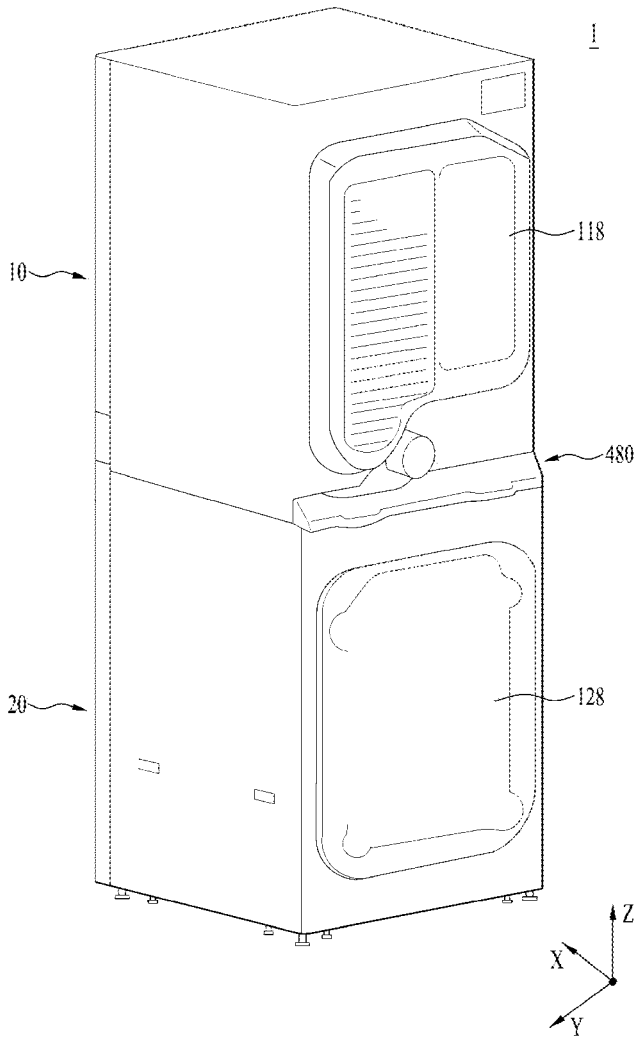
FIG. 20 is a diagram illustrating a perspective view of the exemplary laundry treating apparatus viewed from the rear.
Figure 21:
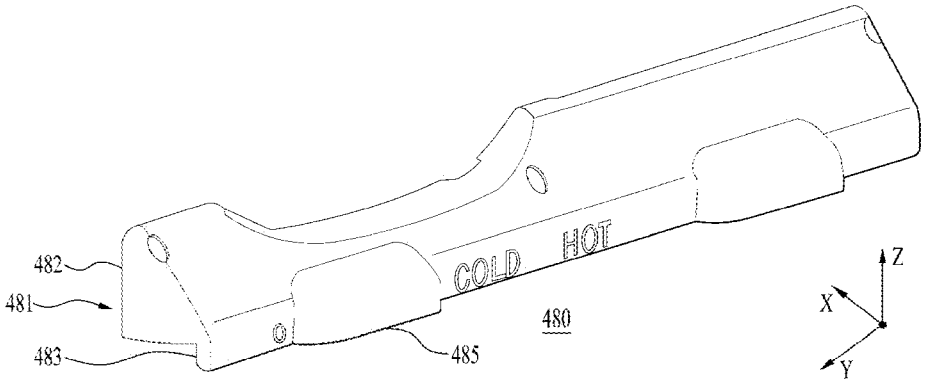
FIG. 21 is a diagram illustrating a view of a rear bracket of the exemplary laundry treating apparatus.

FIG. 20 is a diagram illustrating a view of the laundry treating apparatus 1 viewed from the rear, and FIG. 21 is a diagram illustrating a rear bracket 480 connecting the first treating apparatus 10 and the second treating apparatus 20 with each other at the rear.

As shown in FIGS. 20 and 21, the first treating apparatus 10 can have the first rear panel 118 disposed on the rear face thereof, and the second treating apparatus 20 can have the second rear panel 128 disposed on the rear face thereof. In addition, the rear bracket 480 made of an electrically insulating material and fastening the first rear panel 118 and the second rear panel 128 with each other can be further included.

As described above, the first treating apparatus 10 and the second treating apparatus 20 can be electrically insulated from each other and coupled to each other by the insulating connection member 450 and the upper frame 400 at the front side. Further, the first treating apparatus 10 and the second treating apparatus 20 can be electrically insulated from each other and be coupled to each other through the rear bracket 480 at the rear side.

The first treating apparatus 10 and the second treating apparatus 20 can be manufactured separately from each other, and then can be stacked together and installed to be used together. Therefore, in order to secure the structural stability of the laundry treating apparatus 1, structural fastening between the first treating apparatus 10 and the second treating apparatus 20 stacked together can be included.

Further, as described above, the first treating apparatus 10 and the second treating apparatus 20 can respectively include electricity consuming devices independent of each other, such as the components like the motors, the controllers, or the like, so that it can be advantageous that the first treating apparatus 10 and the second treating apparatus 20 are electrically insulated from each other.

Accordingly, the first treating apparatus 10 and the second treating apparatus 20 can be fastened to each other through the upper frame 400 and the insulating connection member 450 at the front side of the first treating apparatus 10 and the second treating apparatus 20 stacked together, and can be fastened to each other through the rear bracket 480 at the rear side.

The rear bracket 480 can be made of the electrically insulating material. For example, the rear bracket 480 can be made of the electrically insulating material, such as a plastic material, a rubber material, or a synthetic material of the plastic and the rubber.

The rear bracket 480 can have a length parallel to the left and right direction Y, and can have a length corresponding to a width in the left and right direction Y of the first treating apparatus 10 or the treating apparatus 20. The rear bracket 480 can be coupled to the first rear panel 118 of the first treating apparatus 10 and the second rear panel 128 of the second treating apparatus 20 to fasten the first rear panel 118 and the second rear panel 128 to each other.

There may be various coupling schemes between the rear bracket 480, the first rear panel 118, and the second rear panel 128. For example, the rear bracket 480 can be coupled to the first rear panel 118 and the second rear panel 128 together through screws, rivets, or the like, or the hook coupling or the fitting coupling scheme can be used.

Figure 22:
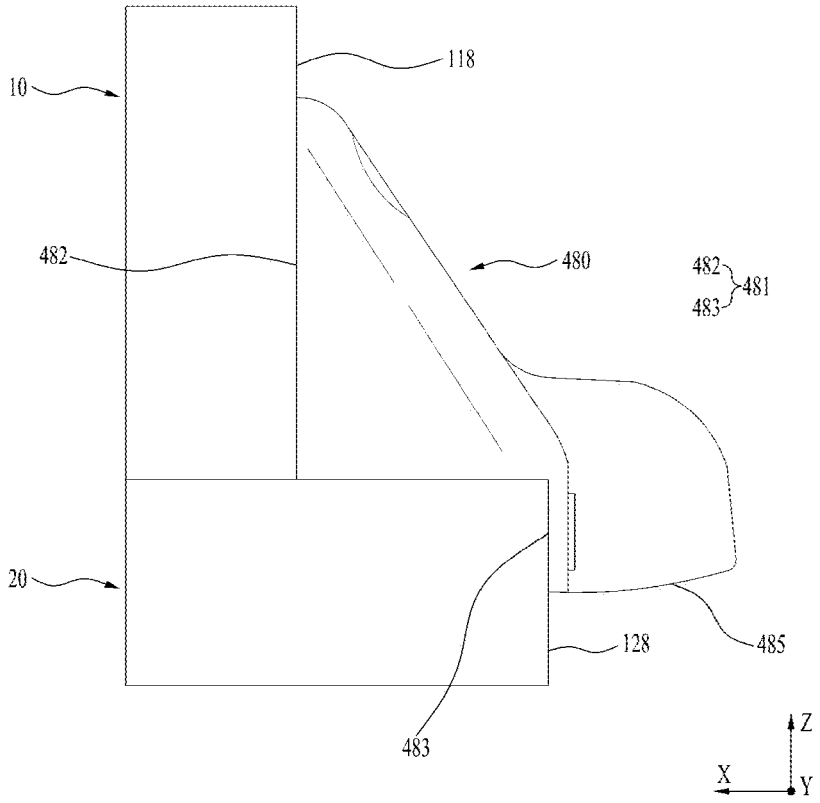
FIG. 22 is a diagram illustrating a side view of a rear bracket in the exemplary laundry treating apparatus.

FIG. 22 is a diagram illustrating a cross-sectional view of the rear bracket 480 coupled to the first rear panel 118 and the second rear panel 128 viewed from the side.

Referring to FIG. 22, the rear bracket 480 can fasten the first rear panel 118 and the second rear panel 128 with each other as an upper portion of the rear bracket 480 is coupled to the first rear panel 118 and a lower portion of the rear bracket 480 is coupled to the second rear panel 128.

In this connection, a front face 481 facing forward of the rear bracket 480 can have an upper end 482 in contact with the first rear panel 118, and a lower end 483 in contact with the second rear panel 128. For example, in the rear bracket 480, the upper end 482 of the front face 481 may support the first rear panel 118 from the rear, and the lower end 483 of the front face 481 may support the second rear panel 128 from the rear.

In some implementations, as shown in FIG. 22, the first rear panel 118 cab be located forward of the second rear panel 128, and the front face 481 of the rear bracket 480 can be defined in a stepped manner such that the upper end 482 supporting the first rear panel 118 is located forward of the lower end 483 supporting the second rear panel 128.

In some implementations, the first rear panel 118 and the second rear panel 128 can be arranged to be spaced apart from each other in the front and rear direction X. For example, the first rear panel 118 can be located forward or rearward of the second rear panel 128. A positional relationship of the first rear panel 118 to the second rear panel 128 can be determined from a design difference between the first treating apparatus 10 and the second treating apparatus 20.

For example, when a length in the front and rear direction X of the first treating apparatus 10 is greater than that of the second treating apparatus 20, the first rear panel 118 can be located rearward of the second rear panel 128. When the length in the front and rear direction X of the first treating apparatus 10 is shorter than that of the second treating apparatus 20, the first rear panel 118 can be located forward of the second rear panel 128.

In some implementations, for an assembly advantage for stacking the first treating apparatus 10 on the second treating apparatus 20, the first rear panel 118 can be positioned in front of the second rear panel 128. For example, in the process of assembling the laundry treating apparatus 1, when the second treating apparatus 20 is placed in an installation region and then the first treating apparatus 10 is lifted on the second treating apparatus 20, the first treating apparatus 10 can slide rearward from a position in front of the second treating apparatus 20 and can be disposed on the second treating apparatus 20.

In this process, the rear bracket 480 can be installed in advance on the second rear panel 128 of the second treating apparatus 20, and the first treating apparatus 10 can be disposed at an appropriate assembly position while a distance of sliding rearward is limited by the rear bracket 480.

In some implementations, the length in the front and rear direction X of the first treating apparatus 10 can be shorter than that of the second treating apparatus 20, or at least the lower portion of the first rear panel 118 can be located forward of the second rear panel 128 such that a stopper role of such rear bracket 480 can be achieved.

The front face 481 of the rear bracket 480 can have the stepped shape as shown in FIG. 22 such that the upper end 482 of the front face 481 that forwardly supports the lower portion of the first rear panel 118 is located forward of the lower end 483 that forwardly supports the upper portion of the second rear panel 128.

When the lower portion of the first rear panel 118 is located rearward of the second rear panel 128, the front face 481 of the rear bracket 480 can have the stepped shape such that the upper end 482 is positioned rearward of the lower end 483.

As the front face 481 of the rear bracket 480 has the stepped shape as above, the rear bracket 480 can be coupled to the first rear panel 118 and the second rear panel 128 and fasten the first rear panel 118 and the second rear panel 128 with each other while allowing a positional difference between the first rear panel 118 and the second rear panel 128, and a support structure for supporting the first rear panel 118 of the first treating apparatus 10 located on the second treating apparatus 20 from the rear can be stably realized.

In some implementations, referring to FIGS. 21 and 22, the laundry treating apparatus 1 can have a handle 485 on the rear bracket 480. Specifically, the handle 485 opening downward can be disposed on the lower portion of the rear bracket 480.

The handle 485 can have a shape of a groove that opens downward and recesses upward. The groove of the handle 485 can be defined such that the user may easily grip the handle 485 by putting a finger into the groove.

There can be various positions and shapes of the handle 485, and FIGS. 21 and 22 show the handle 485 that provides a portion of the lower portion of the rear bracket 480 and is opened downward to be gripped by the user.

FIG. 23 is a diagram illustrating the first bottom panel 119 of the first treating apparatus 10. Referring to FIG. 23, the first treating apparatus 10 can further include the first bottom panel 119 made of an electrically insulating material.

The first bottom panel 119 can be disposed on the bottom face of the first treating apparatus 10, supported by the second treating apparatus 20, and can be made of the electrically insulating material to be electrically insulated from the second treating apparatus 20.

In the first treating apparatus 10, the first bottom panel 119 can be located on the second treating apparatus 20, and the second treating apparatus 20 can upwardly support the first bottom panel 119 of the first treating apparatus 10. For example, the first bottom panel 119 can be in contact with the top face of the second treating apparatus 20.

In some implementations, the first bottom panel 119 can be made of the electrically insulating material. For example, the first bottom panel 119 can be made of a plastic material, a rubber material, or a synthetic material of the plastic, the rubber, and the like.

As the first bottom panel 119 in contact with and supported by the second treating apparatus 20 is made of the electrically insulating material, the first treating apparatus 10 can be electrically insulated from the second treating apparatus 20.

For example, as described above, the front faces of the first treating apparatus 10 and the second treating apparatus 20 can be fastened to each other in a state electrically insulated from each other by the upper frame 400, the insulating connection member 450, and the like, and the rear faces of the first treating apparatus 10 and the second treating apparatus 20 can be fastened to each other in a state electrically insulated from each other by the rear bracket 480. Furthermore, the first bottom panel 119 of the first treating apparatus 10 can be made of the electrically insulating material and supported on the second treating apparatus 20, so that the first treating apparatus 10 and the second treating apparatus 20 can be electrically separated from each other and can be stably fastened to each other.

In the second treating apparatus 20, the second top panel can upwardly support the first bottom panel 119 of the first treating apparatus 10, or the second side panel 125 can upwardly support the first bottom panel 119.

Figure 24:
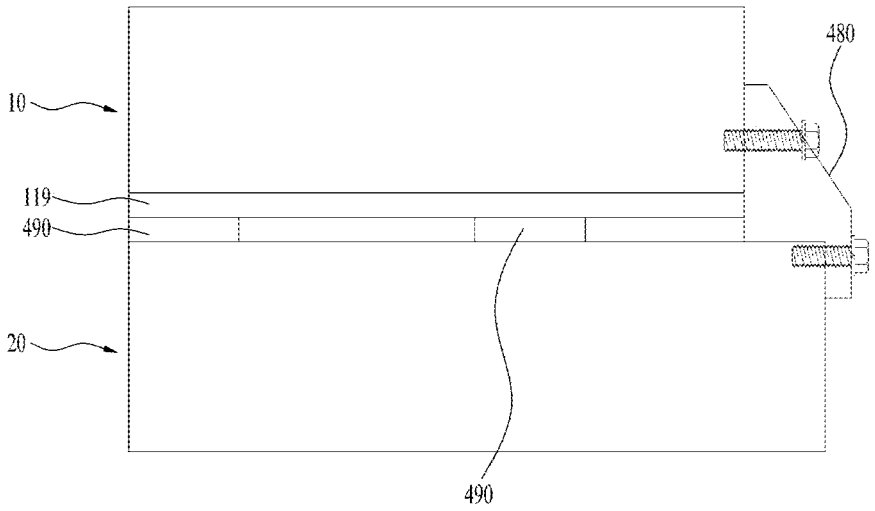
FIG. 24 is a diagram illustrating a view of an insulating support in the exemplary laundry treating apparatus.

FIG. 24 is a diagram illustrating an insulating support 490 disposed between the bottom face of the first treating apparatus 10 and the top face of the second treating apparatus 20.

Referring to FIG. 24, the insulating support 490 that supports the bottom face of the first treating apparatus 10 from the top face of the second treating apparatus 20, and is made of an electrically insulating material to electrically insulate the first treating apparatus 10 and the first treating apparatus 10 from each other can be further included.

The insulating support 490 can protrude downward from the bottom face of the first treating apparatus 10, can protrude upward from the top face of the second treating apparatus 20, or can be manufactured separately from the first treating apparatus 10 and the second treating apparatus 20 and disposed between the first treating apparatus 10 and the second treating apparatus 20.

The insulating support 490 can be disposed beneath the first bottom panel 119 or the first side panel 115 of the first treating apparatus 10, and the insulating support 490 can be disposed in a state in which the first bottom panel 119 of the first treating apparatus 10 is omitted.

In addition, the insulating support 490 can be disposed on a front face of the second top panel or the second side panel 125 of the second treating apparatus 20, or can have a structure in which the second top panel of the second treating apparatus 20 is omitted.

In addition, the insulating support 490 can be disposed on a lower end of the first bottom panel 119 or the first side panel 115 of the first treating apparatus 10, and the second top panel may be omitted in the second treating apparatus 20, so that the insulating support 490 can be supported upward by the second side panel 125 of the second treating apparatus 20.

The insulating support 490 can have various shapes, and can be made of plastic or rubber, or a synthetic material of the plastic, the rubber, and the like.

As the first treating apparatus 10 is supported upward on the second treating apparatus 20 by the insulating support 490, the stable structure in which the first treating apparatus 10 and the second treating apparatus 20 are stacked together but are electrically insulated from each other can be realized.

What is claimed is:

1. A stacked laundry treating apparatus comprising:

a first treating apparatus including:

a first cabinet comprising first side panels disposed at each lateral sides and a first rear panel disposed at a rear side, a first front panel disposed on a front face of the first cabinet and including a first laundry inlet, and a first drum disposed inside the first cabinet and communicating with the first laundry inlet to receive laundry;

a second treating apparatus disposed below the first treating apparatus to support the first treating apparatus, the second treating apparatus including:

a second cabinet comprising second side panels disposed at each lateral sides and a second rear panel disposed at a rear side, a second front panel disposed on a front face of the second cabinet and including a second laundry inlet, a tub disposed inside the second cabinet, and a second drum disposed inside the tub and communicating with the second laundry inlet to receive laundry;

an insulating connection member made of an electrically insulating material and coupled to the first treating apparatus, wherein at least a portion of the insulating connection member is positioned at the front face of the first cabinet; and an upper frame that couples the first treating apparatus and the second treating apparatus based on a state that the first treating apparatus is stacked on the second treating apparatus, the upper frame including:

a lower portion coupled to the front face of the second cabinet; and an upper portion coupled to the insulating connection member at the front face of the first cabinet, wherein the upper frame couples and electrically insulates the first treating apparatus and the second treating apparatus from each other.

2. The stacked laundry treating apparatus of claim 1, further comprising a control panel including an input unit for the first and second treating apparatuses, and wherein the control panel is in a separated state from the first and second treating apparatuses when the first and second treating apparatuses are coupled to each other by the upper frame.

3. The stacked laundry treating apparatus of claim 2, wherein the control panel is inserted and coupled between the first front panel and the second front panel after the upper frame couples the front face of the first cabinet and the front face of the second cabinet.

4. The stacked laundry treating apparatus of claim 3, wherein the first treating apparatus, the control panel, and the second treating apparatus constitute a continuous front surface.

5. The stacked laundry treating apparatus of claim 1, wherein the first treating apparatus is stacked on the second treating apparatus based on a state that the lower portion of the upper frame is coupled to the second treating apparatus, and wherein, after stacking the first treating apparatus on the second treating apparatus, the upper portion of the upper frame is coupled to the first treating apparatus.

6. The stacked laundry treating apparatus of claim 5, wherein the second front panel extends upward beyond an upper surface of the second treating apparatus so that when the first treating apparatus is stacked on the second treating apparatus, the second front panel is positioned at a front side of the first treating apparatus, and wherein the upper frame is disposed behind the second front panel, extends parallel to a front surface of the second front panel, and is coupled to the insulating connection member coupled to the first treating apparatus.

7. The stacked laundry treating apparatus of claim 6, wherein the upper frame extends in a left-right direction, and wherein both side ends of the lower portion of the upper frame are coupled to the second side panels, wherein both side ends of the upper portion of the upper frame are coupled to the first side panels after stacking the first treating apparatus, wherein the coupling the upper frame and the first side panels is performed via the insulating connection member such that the both side ends of the upper portion of the upper frame are spaced apart from the first side panels.

8. The stacked laundry treating apparatus of claim 1, wherein the insulating connection member is disposed at a rear side of the upper portion of the upper frame, and wherein the upper frame is coupled to the insulating connection member such that the upper frame is spaced apart from the first side panel.

9. The stacked laundry treating apparatus of claim 8, wherein the insulating connection member is disposed at a lower portion of the first treating apparatus, and wherein the insulating connection member includes a first fastening portion coupled to the first side panel and a second fastening portion coupled to the upper frame.

10. The stacked laundry treating apparatus of claim 9, wherein the insulating connection member electrically insulates between the first side panel and the upper frame.

11. The stacked laundry treating apparatus of claim 9, wherein the upper frame comprises a second fastening member inserted into and coupled with the second fastening portion, and wherein the second fastening member is electrically insulated from the first side panel.

12. The stacked laundry treating apparatus of claim 11, wherein the second fastening portion surrounds the second fastening member.

13. The stacked laundry treating apparatus of claim 11, wherein the second fastening member penetrates the upper frame and inserted into the second fastening portion.

14. The stacked laundry treating apparatus of claim 11, wherein a portion of the second fastening portion is inserted into the inner side of the first side panel.

15. The stacked laundry treating apparatus of claim 1, wherein the upper frame is disposed in front of the first side panel, wherein the insulating connection member is disposed between the upper frame and the first side panel to space apart the upper frame from the first side panel.

16. The stacked laundry treating apparatus of claim 15, wherein the second front panel includes an upper fastening portion extending beyond an upper surface of the first treating apparatus, and wherein the upper fastening portion is coupled to the insulating connection member along with the upper frame.

17. The stacked laundry treating apparatus of claim 15, wherein both lateral ends of the upper frame extend from the second side panel over the upper surface of the second treating apparatus and further extend to the front of the first side panel, and wherein the upper frame is coupled to the insulating connection member to electrically insulate from the first side panel.

18. The stacked laundry treating apparatus of claim 15, wherein the insulating connection member extends downward along the first side panel.

19. The stacked laundry treating apparatus of claim 1, further comprising an insulating support made of an insulating material and disposed between the first side panel and the second side panel, and wherein the insulating support spaced apart the first side panel and the second side panel in a vertical direction based on a state that the first treating apparatus is stacked on the second treating apparatus.

20. The stacked laundry treating apparatus of claim 19, wherein the insulating support electrically insulates the first side panel and the second side panel in lateral sides, and the insulating connection member electrically insulates the upper frame and the first treating apparatus in a front side.

21. A stacked laundry treating apparatus comprising:

a first treating apparatus including:

a first cabinet comprising first side panels disposed at each lateral side and a first rear panel disposed at a rear side, a first front panel disposed on a front face of the first cabinet and including a first laundry inlet, a first drum disposed inside the first cabinet, communicating with the first laundry inlet opening, and configured to receive laundry;

a second treating apparatus disposed below the first treating apparatus to support the first treating apparatus, the second treating apparatus including:

a second cabinet comprising second side panels disposed at each lateral side and a second rear panel disposed at a rear side, a second front panel disposed on a front face of the second cabinet and including a second laundry inlet, a tub disposed inside the second cabinet, a second drum disposed inside the tub, communicating with the second laundry inlet, and configured to receive laundry;

an upper frame including an upper portion that is coupled to the first treating apparatus and a lower portion that is coupled to the second treating apparatus; and an insulating connection member made of an electrically insulating material and positioned between the upper frame and one of the first or second treating apparatuses to electrically insulate the first treating apparatus and the second treating apparatus.

22. The stacked laundry treating apparatus of claim 21, further comprising a control panel including an input unit for controlling the first and second treating apparatuses, wherein after the first treating apparatus is stacked on the second treating apparatus and the upper frame couples the front face of the first cabinet and the front face of the second cabinet, the control panel is inserted between the first front panel and the second front panel.

23. The stacked laundry treating apparatus of claim 22, wherein the control panel is disposed and coupled at a lower front face of the first treating apparatus.

24. The stacked laundry treating apparatus of claim 22, further comprising an insulating support made of an insulating material and disposed independently from the first and second treating apparatuses, wherein the insulating support is supported by an upper surface of the second side panel, supports a bottom face of the first side panel, and is positioned between the first and second treating apparatuses, and wherein the insulating connection member is disposed at a rear side of the upper frame in a position where the control panel is arranged, providing insulation to the upper frame.

* * * * *